US011209766B2

(12) United States Patent
Inaba et al.

(10) Patent No.: US 11,209,766 B2
(45) Date of Patent: Dec. 28, 2021

(54) CLEANING DEVICE AND IMAGE FORMING APPARATUS

(71) Applicant: CANON KABUSHIKI KAISHA, Tokyo (JP)

(72) Inventors: Yuichiro Inaba, Kanagawa (JP); Norihiro Matsumoto, Tokyo (JP); Shohei Ishio, Tokyo (JP); Keisuke Ishizumi, Kanagawa (JP); Shinji Katagiri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/068,392

(22) Filed: Oct. 12, 2020

(65) Prior Publication Data

US 2021/0132539 A1 May 6, 2021

(30) Foreign Application Priority Data

Oct. 31, 2019 (JP) ..... JP2019-199100
Nov. 29, 2019 (JP) ..... JP2019-216691
Sep. 4, 2020 (JP) ..... JP2020-148807

(51) Int. Cl.

*G03G 21/00* (2006.01)
*G03G 15/16* (2006.01)
*G03G 15/08* (2006.01)
*G03G 21/10* (2006.01)

(52) U.S. Cl.

CPC ..... *G03G 21/0011* (2013.01); *G03G 15/0875* (2013.01); *G03G 15/0891* (2013.01); *G03G 15/161* (2013.01); *G03G 21/105* (2013.01)

(58) Field of Classification Search

CPC ..... G03G 15/161; G03G 21/0011; G03G 21/007; G03G 21/105; G03G 2221/001; G03G 15/0875; G03G 15/0891

See application file for complete search history.

(56) References Cited

U.S. PATENT DOCUMENTS 5,315,357 A * 5/1994 Kamijo ..... G03G 21/0011 15/256.5 X
5,812,902 A * 9/1998 Lee ..... G03G 15/55 399/25
6,643,487 B1 * 11/2003 Shimmura ..... G03G 15/161 399/302 X (Continued)

FOREIGN PATENT DOCUMENTS

JP 2004-240040 A 8/2004
JP 2009-210895 A 9/2009

(Continued)

*Primary Examiner* — Sophia S Chen
(74) *Attorney, Agent, or Firm* — Canon U.S.A., Inc., IP Division

(57) ABSTRACT

A cleaning device includes a conveyance member, an agitation member, and an accommodation unit. The conveyance member extends in a width direction of an image bearing member orthogonal to a moving direction of the image bearing member, and conveys toner in the width direction by rotation. The accommodation unit includes a wall portion located inside a rotation orbit of an outermost peripheral portion of the agitation member, downstream of the collection member and upstream of the conveyance member in a rotation direction of the agitation member when viewed in a rotation axis direction of the conveyance member.

22 Claims, 16 Drawing Sheets

(56) References Cited

U.S. PATENT DOCUMENTS

| | | | | |
|---|---|---|---|---|
| 2011/0097104 | A1* | 4/2011 | Sueoka | G03G 15/161 399/101 |
| 2015/0071691 | A1* | 3/2015 | Fujii | G03G 21/105 399/350 |
| 2015/0177653 | A1* | 6/2015 | Seki | G03G 15/161 399/101 |
| 2015/0301494 | A1* | 10/2015 | Kitabayashi | G03G 15/161 399/71 |
| 2016/0033922 | A1* | 2/2016 | Nodera | G03G 21/08 399/128 |
| 2019/0317431 | A1* | 10/2019 | Ishio | G03G 15/161 |

FOREIGN PATENT DOCUMENTS

| | | | |
|---|---|---|---|
| JP | 2012-133267 | A | 7/2012 |
| JP | 2014-174227 | A | 9/2014 |
| JP | 2016-218435 | A | 12/2016 |
| JP | 2018-054649 | A | 4/2018 |
| JP | 2019-194669 | A | 11/2019 |

* cited by examiner

Comparative Art

CLEANING DEVICE AND IMAGE FORMING APPARATUS

BACKGROUND OF THE INVENTION

Field of the Invention

The present disclosure relates to a cleaning device and an image forming apparatus including a cleaning device.

Description of the Related Art

An electrophotographic image forming apparatus including a transfer belt or a photosensitive drum serving as an image bearing member for bearing a toner image and a cleaning unit that collects toner remaining on the transfer belt or photosensitive drum has heretofore been known. The cleaning unit includes a frame and a cleaning blade that is located in contact with the transfer belt or photosensitive drum and serves as a collection member for collecting the toner remaining on the transfer belt or photosensitive drum.

Japanese Patent Application Laid-Open No. 2016-218435 discusses a configuration of an image forming apparatus including a cleaning unit that includes a conveyance member for conveying toner collected from a photosensitive drum by a cleaning blade, and an accommodation unit that accommodates the toner collected by the cleaning unit. According to Japanese Patent Application Laid-Open No. 2016-218435, the toner collected by the cleaning blade accumulates inside the frame and then reaches the conveyance member, which is located above the cleaning blade in the direction of gravity. When the toner reaches the conveyance member, the toner is conveyed to the accommodation unit by the conveyance member that rotates by receiving a driving force.

SUMMARY OF THE INVENTION

The present disclosure is directed to preventing occurrence of a cleaning failure in an image forming apparatus including a cleaning unit that conveys toner collected from an image bearing member by a collection member contacting the image bearing member by using a conveyance member.

According to an aspect of the present disclosure, a cleaning device configured to collect toner remaining on a movable image bearing member configured to bear a toner image includes a collection member configured to contact the image bearing member and collect the toner remaining on the image bearing member, a conveyance member configured to convey the toner collected by the collection member, the conveyance member being located above a position where the collection member contacts the image bearing member in a direction of gravity, a rotatable flexible agitation member configured to agitate the toner collected by the collection member, the agitation member being located above the position where the collection member contacts the image bearing member in a direction of gravity, and an accommodation unit configured to accommodate the toner collected from the image bearing member by the collection member, the accommodation unit accommodating the conveyance member and the agitation member. The conveyance member extends in a width direction of the image bearing member orthogonal to a moving direction of the image bearing member, and conveys the toner in the width direction by rotation. The accommodation unit includes a wall portion located inside a rotation orbit of an outermost peripheral portion of the agitation member, downstream of the collection member and upstream of the conveyance member in a rotation direction of the agitation member when viewed in a rotation axis direction of the conveyance member.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. The dimensions, materials, shapes, and relative arrangement of components described in the exemplary embodiments are to be modified as appropriate depending on the configuration and various conditions of apparatuses to which the exemplary embodiments are applied, and are not intended to limit the scope of the invention to the following exemplary embodiments.

[Image Forming Apparatus]

Figure 1:
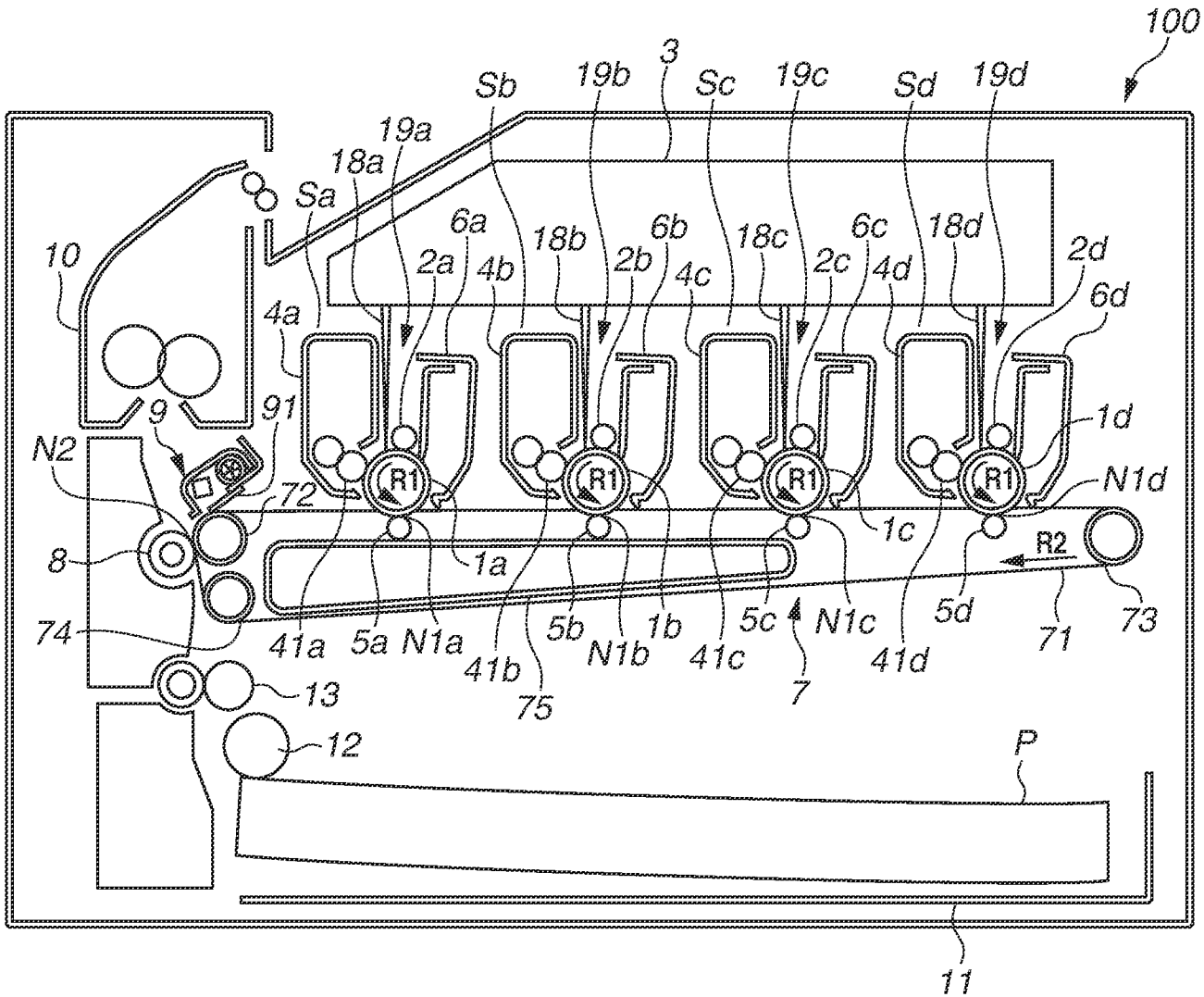
FIG. 1 is a schematic sectional view for describing a configuration of an image forming apparatus.

FIG. 1 is a schematic sectional view illustrating a configuration of an image forming apparatus 100 according to a first exemplary embodiment. The image forming apparatus 100 according to the present exemplary embodiment is an image forming apparatus of tandem type, including a plurality of image forming units Sa, Sb, Sc, and Sd. A first image forming unit Sa forms an image with yellow (Y) color toner. A second image forming unit Sb forms an image with magenta (M) color toner. A third image forming unit Sc forms an image with cyan (C) color toner. A fourth image forming unit Sd forms an image with black (Bk) color toner. These four image forming units Sa to Sd are arranged in a row at regular distances. Most of the configuration of the image forming units Sa to Sd is substantially common except the colors of the accommodated toners. In the following description, the suffixes a, b, c, and d attached to the reference numerals for the purpose of indicating which color the components are intended for will therefore be omitted and a comprehensive description will be given if no particular distinction is needed.

An image forming unit S includes a photosensitive drum 1, a charging roller 2, a developing unit 4, and a drum cleaning unit 6 (cleaning device). The photosensitive drum 1 is a drum-shaped photosensitive member. The charging roller 2 serves as a charging unit configured to charge the photosensitive drum 1. In the present exemplary embodiment, the photosensitive drum 1, the charging roller 2, the developing unit 4, and the drum cleaning unit 6 are integrated as a process cartridge 19. The process cartridge 19 is detachably attachable to an apparatus main body of the image forming apparatus 100.

The photosensitive drum 1 is an image bearing member for bearing a toner image, and is driven to rotate in a direction of an arrow R1 in the diagram at a predetermined process speed. The developing unit 4 accommodates toner serving as a developing agent (in the present exemplary embodiment, non-magnetic one-component developing agent). The developing unit 4 includes a developing roller 41 serving as a developing member for developing a toner image on the photosensitive drum 1 with the toner, and a developing application blade (not-illustrated) serving as a developing agent regulation member. The toner accommodated in the developing unit 4 is borne on the developing roller 41 at a position where the developing application blade is opposed to the developing roller 41. The toner is then conveyed to a facing portion (developing portion) between the photosensitive drum 1 and the developing roller 41 by a rotation of the developing roller 41.

The drum cleaning unit 6 is a unit for collecting toner adhering to the photosensitive drum 1. The drum cleaning unit 6 includes a cleaning member that contacts the photosensitive drum 1, such as a fur brush and a cleaning blade, and a waste toner container that accommodates toner removed from the photosensitive drum 1 by the cleaning member.

An exposure unit 3 can include a laser scanner unit that scans laser light by using a polygon mirror, or a light-emitting diode (LED) array. In the present exemplary embodiment, the exposure unit 3 includes a laser scanner unit. As will be detailed below, the exposure unit 3 forms an electrostatic latent image on the surface of the photosensitive drum 1 by irradiating the photosensitive drum 1 with a scan beam 18 modulated based on an image signal.

When an image forming operation is started by a control unit (not illustrated) receiving an image signal, the photosensitive drum 1 is driven to rotate. In the process of rotation, the photosensitive drum 1 is uniformly charged to a predetermined potential (charging potential) of predetermined polarity (in the present exemplary embodiment, negative polarity) by the charging roller 2 to which a voltage is applied from a not-illustrated charging power supply. The photosensitive drum 1 is irradiated with the scan beam 18 based on the image signal from the exposure unit 3. An electrostatic latent image corresponding to each color component image of an intended color image is thereby formed in each image forming unit S. The electrostatic latent image is then developed at a developing position by the developing roller 41 to which a voltage is applied from a not-illustrated developing power supply. The electrostatic latent image is thereby visualized as a toner image on the photosensitive drum 1.

In the present exemplary embodiment, a normal charging polarity of the toner accommodated in the developing unit 4 is negative. In the present exemplary embodiment, the electrostatic latent image is developed by reversal development using toner charged to a same polarity as a charging polarity of the photosensitive drum 1 by a developing member. However, the present exemplary embodiment is also applicable to an image forming apparatus configured to develop an electrostatic latent image by positive development using toner charged to a polarity opposite to the charging polarity of the photosensitive drum 1.

An intermediate transfer belt 71 (image bearing member) serving as an endless movable intermediate transfer member is located at a position where the intermediate transfer belt 71 contacts the photosensitive drums 1 of the respective image forming units S. The intermediate transfer belt 71 is stretched by three rollers, which are stretching members, namely, a driving roller 72, a tension roller 73, and a driven roller 74. The intermediate transfer belt 71 is stretched in a state where a predetermined tension is applied thereto by the tension roller 73, and moved in the direction of the arrow R2 in the diagram by rotation of the driving roller 72 that rotates by receiving a driving force. As will be detailed below, the intermediate transfer belt 71 according to the present exemplary embodiment includes a plurality of layers.

The toner image formed on each photosensitive drum 1 is primarily transferred to the intermediate transfer belt 71 in the process of passing through a primary transfer portion N1 where the photosensitive drum 1 contacts the intermediate transfer belt 71. At this time, a voltage having a polarity (in the present exemplary embodiment, positive polarity) opposite to the normal charging polarity of the toner is applied to a primary transfer roller 5 from a not-illustrated primary transfer power supply. Toner not primarily transferred to the intermediate transfer belt 71 and remaining on the photosensitive drum 1 is then collected and removed from the surface of the photosensitive drum 1 by the drum cleaning unit 6. The primary transfer roller 5 is a primary transfer member (contact member), which is located at a position corresponding to the photosensitive drum 1 via the intermediate transfer belt 71 and contacts the inner peripheral surface of the intermediate transfer belt 71.

In such a manner, the color toner images formed in the respective image forming units S are successively transferred to the intermediate transfer belt 71 in a superposed manner at the respective primary transfer portions N1. Four color toner images corresponding to the intended color image are thereby formed on the intermediate transfer belt 71.

Transfer materials P are stacked in a feed cassette 11 serving as a storage unit. One of the transfer materials P is fed by a feed roller 12 serving as a feed unit and then conveyed to a conveyance roller 13 in synchronization with the formation of the electrostatic latent images on the photosensitive drums 1 by the exposure unit 3. The transfer material P is then conveyed to a secondary transfer portion N2 by the conveyance roller 13 in synchronization with the timing when the four color toner images borne on the intermediate transfer belt 71 reaches the secondary transfer portion N2. The secondary transfer portion N2 is formed by a secondary transfer roller 8 contacting the intermediate transfer belt 71. The four color toner images borne on the intermediate transfer belt 71 are then secondarily transferred simultaneously to the surface of the transfer material P, such as a sheet of paper and an overhead projector (OHP) sheet, fed by the feed roller 12.

The secondary transfer roller 8 is in contact with an outer peripheral surface of the intermediate transfer belt 71. The secondary transfer roller 8 is pressed against the driving roller 72 located at a position opposed to the secondary transfer roller 8 via the intermediate transfer belt 71 by a pressing force of 50N to form the secondary transfer portion N2. The four color toner images borne on the intermediate transfer belt 71 are secondarily transferred simultaneously to the surface of the transfer material P in the process of passing through the secondary transfer portion N2. At this time, a voltage having a polarity (in the present exemplary embodiment, positive polarity) opposite to the normal charging polarity of the toner is applied to the secondary transfer roller 8 from a not-illustrated secondary transfer power supply.

The transfer material P to which the four color toner images are transferred by secondary transfer is then heated and pressed in a fixing unit 10, whereby the four color toners are melted, mixed in color, and fixed to the transfer material P. Toner remaining on the intermediate transfer belt 71 after the secondary transfer is cleaned and removed by a cleaning unit 9 (collection unit) located downstream of the secondary transfer portion N2 in the moving direction of the intermediate transfer belt 71.

The cleaning unit 9 includes an elastic cleaning blade 91 made of urethane rubber. The cleaning blade 91 is a collection member contacting the outer peripheral surface of the intermediate transfer belt 71 at a position opposed to driving roller 72. The toner collected from the surface of the intermediate transfer belt 71 by the cleaning blade 91 is conveyed to a collection container 75 located in a region formed by the inner peripheral surface of the intermedia transfer belt 71 and collected into the collection container 75. In the following description, the cleaning blade 91 will be referred to simply as a blade 91. The blade 91 is located at a position opposed to the driving roller 72 via the intermediate transfer belt 71. The blade 91 makes contact with the intermediate transfer belt 71 in a counter direction with respect to the moving direction of the intermediate transfer belt 71.

The image forming apparatus 100 according to the present exemplary embodiment forms a full-color print image by the foregoing operation.

In the image forming apparatus 100 according to the present exemplary embodiment, the transfer material P is conveyed vertically upward to the secondary transfer portion N2 in the direction of gravity. In the present exemplary embodiment, as illustrated in FIG. 1, the cleaning unit 9 is located above the driving roller 72 in a direction of gravity.

In the image forming apparatus 100 according to the present exemplary embodiment, the intermediate transfer belt 71, the cleaning unit 9, and the collection container 75 are integrated as an intermediate transfer unit 7. The intermediate transfer unit 7 is detachably attachable to the apparatus main body of the image forming apparatus 100.

The image forming operation of the image forming apparatus 100 according to the present exemplary embodiment has been described above by using an example where the four image forming units Sa to Sd are used to form an image. However, the image forming apparatus 100 can also form a monochrome or full-color image by performing image formation using one or more (not all) image forming units S desired.

[Intermediate Transfer Unit]

Figure 2:
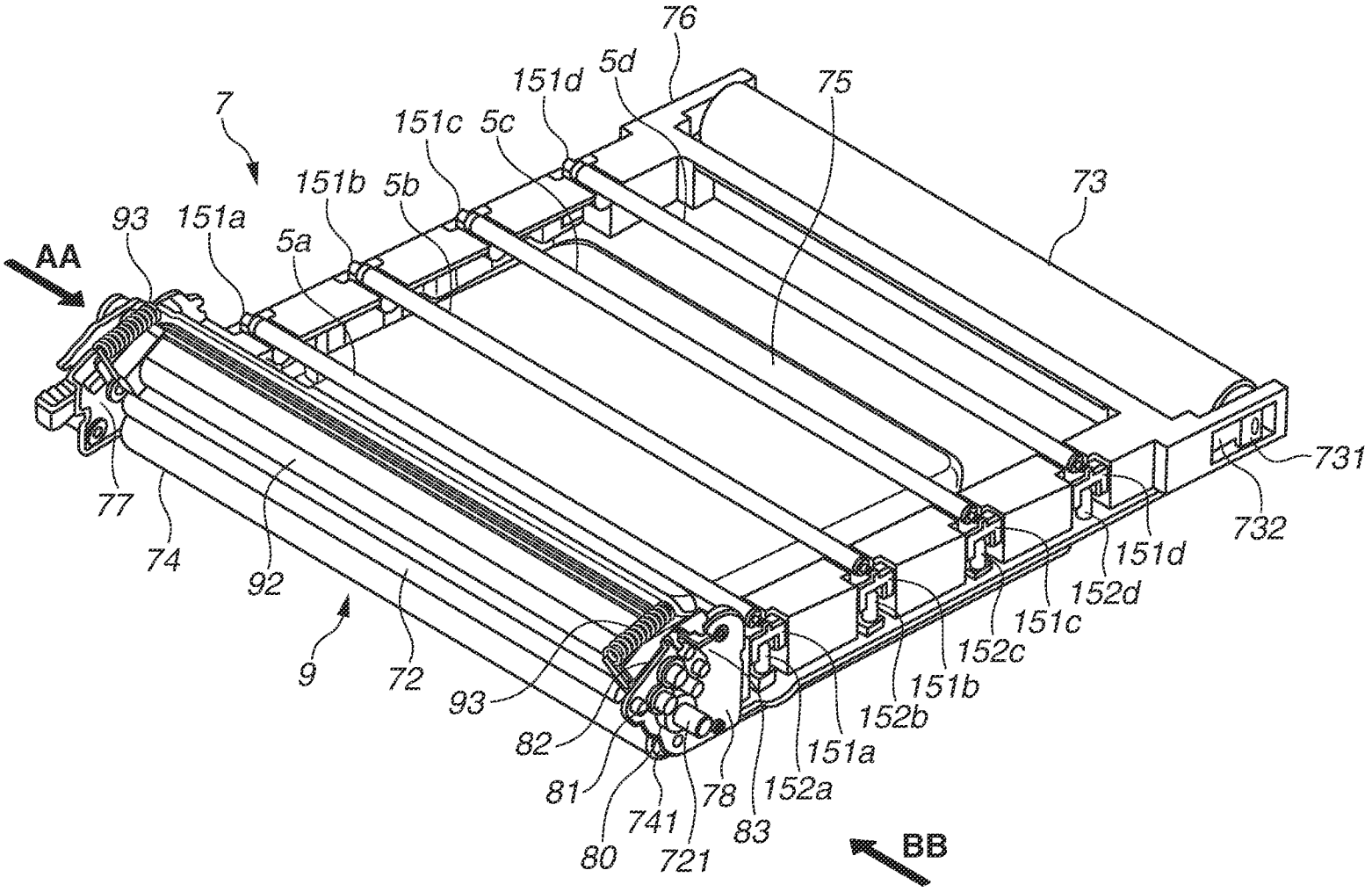
FIG. 2 is a schematic perspective view for describing a configuration of an intermediate transfer unit.
Figure 3:
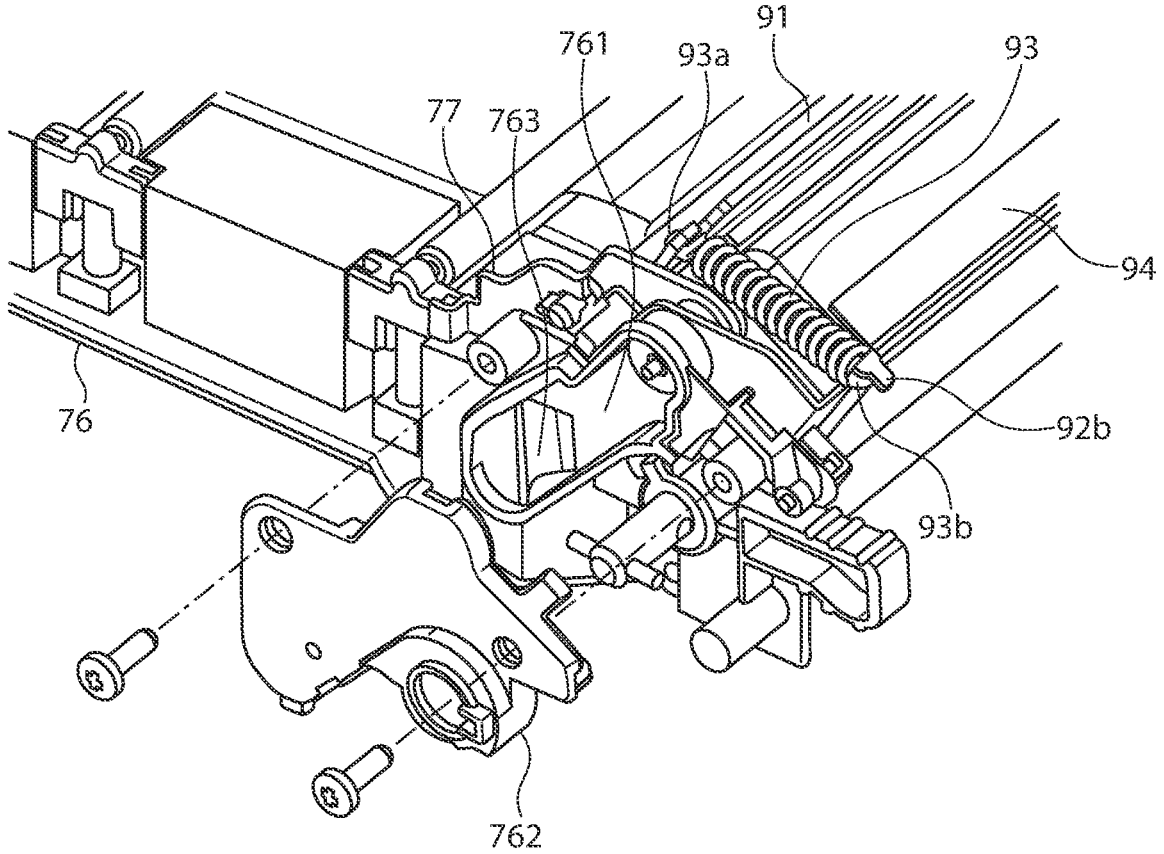
FIG. 3 is a schematic diagram for describing a driving-side configuration of the intermediate transfer unit.
Figure 4:
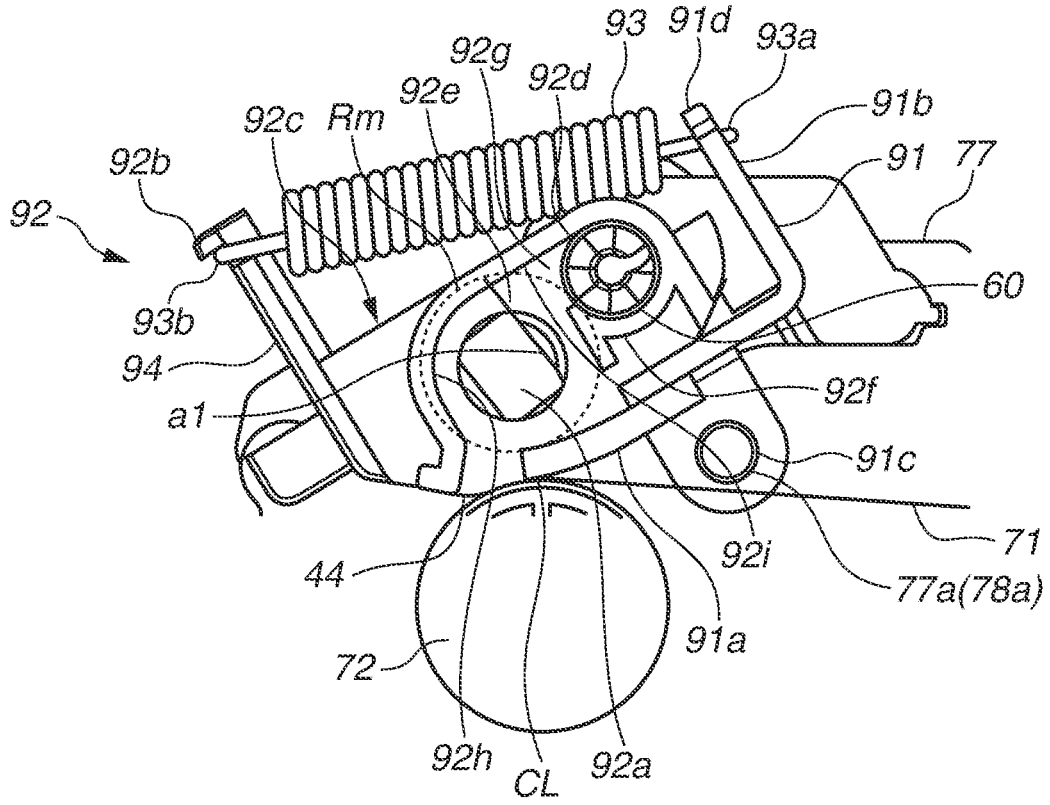
FIG. 4 is a schematic sectional view for describing a configuration of a cleaning unit.

A configuration of the intermediate transfer unit 7 will now be described with reference to FIGS. 2, 3, and 4. FIG. 2 is a perspective view illustrating an outline of the intermediate transfer unit 7. For ease of description, the intermediate transfer belt 71 is omitted in FIG. 2. FIG. 3 is a schematic diagram illustrating the intermediate transfer unit 7 of FIG. 2 as viewed in the direction of the arrow AA illustrated in FIG. 2, and a simplified schematic exploded view for describing a configuration of the cleaning unit 9. FIG. 4 is a schematic sectional view of the intermediate transfer unit 7 of FIG. 2, viewed in the direction of the arrow BB.

As illustrated in FIG. 2, the intermediate transfer unit 7 stretches and supports the intermediate transfer belt 71 by three stretching rollers: the driving roller 72, the tension roller 73, and the driven roller 74. The driving roller 72 is rotatably supported at both ends by bearings 721. A predetermined rotational driving force is transmitted from the apparatus main body to one end of the driving roller 72 in the rotation axis direction, whereby the driving roller 72 is rotated. In the following description, the one end side to which the driving force is transmitted will be referred to as a driving side (side of the arrow AA in FIG. 2), and the opposite side will be referred to as a non-driving side (side of the arrow BB in FIG. 2). In the present exemplary embodiment, a roller is used as the driving roller 72; the roller is obtained by coating an aluminum core with rubber in which carbon is dispersed as a conductive agent and pressing stainless steel (SUS) or other metal shafts into both ends of the resulting pipe having a diameter of approximately 25 mm.

In the present exemplary embodiment, a metal rod of aluminum having a diameter of approximately 25 mm is used as the tension roller 73. Bearings 731 are located at both ends in the rotation axis direction of the tension roller 73. The bearings 731 are urged by compression springs 732, whereby both ends of the tension roller 73 are urged, so that a predetermined tension is applied to the intermediate transfer belt 71. Like the tension roller 73, the driven roller 74 is a metal rod of aluminum. The driven roller 74 is rotatably supported at both ends by bearings 741.

The primary transfer rollers 5 are located at positions corresponding to the photosensitive drums 1 with the intermediate transfer belt 71 therebetween. The primary transfer rollers 5 are each supported at both ends in the rotation axis direction by bearings 151. The primary transfer rollers 5 are urged toward the intermediate transfer belt 71 with a predetermined force by compression springs 152 via the bearings 151, and driven to rotate by the rotation of the intermediate transfer belt 71. In the present exemplary embodiment, rollers made of SUS or other metal rods having a diameter of approximately 6 mm are used as the primary transfer rollers 5. At least either one of the bearings 151 located at both ends of each primary transfer roller 5 includes a conductive member. A voltage of positive polarity is applied from the not-illustrated primary transfer power supply to the primary transfer rollers 5, whereby toner images are primarily transferred from the photosensitive drums 1 to the intermediate transfer belt 71.

The intermediate transfer belt 71 can be suitably made of materials such as rubber and resin. In the present exemplary embodiment, an endless belt-shaped film is used as the intermediate transfer belt 71; the endless belt-shaped film is made of a resin material having an intermediate resistivity with a thickness of approximately 60 μm in a thickness direction orthogonal to the moving direction of the intermediate transfer belt 71 and the directions of the rotation axes of the stretching rollers.

A frame 76 is a frame of the intermediate transfer unit 7 for supporting the stretching rollers. The frame 76 is molded of a resin material. The bearings 151 supporting the primary transfer rollers 5 at both ends and the bearings 731 supporting the tension roller 73 at both ends are supported by the frame 76 in such a state that the bearings 151 and 731 can move with respect to the frame 76 in the pressing directions of the respective compression springs.

A support plate 77 and a support plate 78 are located near the driving roller 72 supported by the frame 76. The support plates 77 and 78 rotatably support the driving roller 72 and the driven roller 74 via the bearings. The support plates 77 and 78 are positioned and fixed to the frame 76 with screws on both sides of the driving roller 72 in the rotation axis direction. In the present exemplary embodiment, pressed metal plates are used as the support plates 77 and 78.

As will be detailed below, the cleaning unit 9 includes, as illustrated in FIGS. 2 to 4, the blade 91 serving as a cleaning member, and the collection unit 92 that collects the toner removed from the intermediate transfer belt 71 by the blade 91. The blade 91 and the collection unit 92 are positioned and fixed to the support plates 77 and 78.

The toner removed from the intermediate transfer belt 71 by the blade 91 is temporarily accommodated in the collection unit 92. The toner is then conveyed inside the collection unit 92 before collected into the collection container 75 via a toner conveyance path 761 located on the driving side of the frame 76 illustrated in FIG. 3. The toner conveyance path 761 is sealed by fastening a conveyance path cover 762 with screws, whereby the toner is prevented from leaking out of the intermediate transfer unit 7.

The collection container 75 includes molded resin parts. A plurality of resin parts is bonded to constitute a container sealed at the outer periphery. The collection container 75 is fixed to the frame 76 with screws. The collection container 75 is equipped with a detection unit (not illustrated), such as an optical sensor, for detecting that the collection container 75 is filled up with toner. This enables user notification of the replacement time of the collection container 75. The collection container 75 that is full can be replaced with a new one by a serviceperson or user replacing the intermediate transfer unit 7.

[Cleaning Unit]

As illustrated in FIGS. 2 to 4, the cleaning unit 9 includes, as already described above, the blade 91 serving as the cleaning member, and the collection unit 92 for temporarily accommodating the toner removed from the intermediate transfer belt 71 by the blade 91 and conveying the toner to the collection container 75.

As illustrated in FIG. 4, the blade 91 includes an elastic urethane rubber 91*a* and a holding plate 91*b* to which the urethane rubber 91*a* is bonded. The length of the urethane rubber 91*a* in the longitudinal direction (the rotation axis direction of the driving roller 72) of the urethane rubber 91*a* is set to be greater than the width of an image forming region where toner images can be borne on the intermediate transfer belt 71. The blade 91 is located to contact the intermediate transfer belt 71 with pressure and can remove the toner remaining on the intermediate transfer belt 71.

To ensure the removal of the toner, the blade 91 is pressed against the intermediate transfer belt 71 with a predetermined pressure. In the present exemplary embodiment, the blade 91 is opposed to at least one of the plurality of stretching rollers stretching the intermediate transfer belt 71, whereby the predetermined pressure is obtained. More specifically, the blade 91 is located to be opposed to the driving roller 72 and contact the intermediate transfer belt 71 at a position downstream of the secondary transfer portion N2 in the moving direction of the intermediate transfer belt 71 and above the driving roller 72 in a direction of gravity.

Holes 91*c* and spring catches 91*d* are located at both ends of the holding plate 91*b* in the longitudinal direction of the blade 91. The holes 91*c* are intended to rotatably support the blade 91. On the spring catches 91*d*, tension springs are hooked for pressing the blade 91 against the intermediate transfer belt 71. The blade 91 is engaged with blade support shafts 77*a* and 78*a* made of metal, caulked with the support plates 77 and 78, via the holes 91*c* at both ends. The blade 91 is thereby supported in a rotatable state where the blade 91 can freely contact and be separated from the intermediate transfer belt 71.

The spring catches 91*d* located at both longitudinal ends of the blade 91 and spring catches 92*b* located at both longitudinal ends of the collection unit 92 are engaged with hooks 93*a* and 93*b* of the tension springs 93, respectively. The hooks 93*a* and 93*b* are located at both ends in a direction of extension and contraction. More specifically, as illustrated in FIGS. 3 and 4, the spring catches 91*d* are engaged with the hooks 93*a* and the spring catches 92*b* are engaged with the hooks 93*b*, whereby the tension springs 93 are stretched between the spring catches 91*d* and 92*b*. The tension springs 93 thereby produce moment on the blade 91 about the holes 91*c*, and the blade 91 is pressed against the intermediate transfer belt 71 with a predetermined pressure.

In the collection unit 92, a plurality of not-illustrated seal members is attached to the frame 94 with a two-sided adhesive tape each to prevent the toner collected from the intermediate transfer belt 71 from leaking out of the frame 94 of the collection unit 92. In the moving direction of the intermediate transfer belt 71, a sheet member 44 is located upstream of a cleaning portion CL. The sheet member 44 contacts the intermediate transfer belt 71 and seals a gap between the collection unit 92 and the intermediate transfer belt 71. The cleaning portion CL is a place where the blade 91 contacts the intermediate transfer belt 71. The sheet member 44 serving as a sealing member is located to extend in the width direction of the intermediate transfer belt 71. With such a configuration, in the present exemplary embodiment, the toner primarily collected into the collection unit 92 is conveyed to the collection container 75 without leaking out of the cleaning unit 9.

<Conveyance of Toner in Conveyance Unit>

As illustrated in FIG. 4, the collection unit 92 includes a toner accommodation unit 92*c* that can temporarily accommodate the toner removed by the blade 91, and a screw 92*d* serving as a conveyance member for conveying the collected toner in the longitudinal direction of the blade 91. The collection unit 92 according to the present exemplary embodiment includes a sheet member 92*e* (agitation member) and a rotating shaft 92*a* located inside the toner accommodation unit 92*c*. The sheet member 92*e* is located to extend continuously over substantially the entire area of the toner accommodation unit 92*c* in the longitudinal direction of the blade 91.

The sheet member 92*e* is a flexible sheet member, such as a polyethylene terephthalate (PET) sheet, having a thickness of approximately 80 μm. The sheet member 92*e* is fixed to the rotating shaft 92*a* extending throughout the interior of the collection unit 92 in the longitudinal direction of the blade 91, and can be rotated by the rotating shaft 92*a*. The rotating shaft 92*a* is made of a resin member. The rotating shaft 92*a* has at least one flat portion al parallel to an extending direction of the rotating shaft 92*a*. The sheet member 92*e* is fixed at one end to the flat portion al with, for example, a two-sided adhesive tape (not illustrated). When viewed in the rotation axis direction of the rotating shaft 92*a*, one end of the sheet member 92*e* in a radial direction of a rotation orbit Rm of the sheet member 92*e* is fixed to the flat portion al. The other end opposite from the one end is a free end. The rotation orbit Rm refers to that of the endmost portion of the free end of the sheet member 92*e*.

On one end of the rotating shaft 92*a* in the rotation axis direction, a third gear 82 for rotational driving is located. As illustrated in FIG. 2, a first gear 80 is located on a shaft end of the driving roller 72 on one end side in the direction of the rotation axis of the driving roller 72. Driving force is transmitted from the first gear 80 to a second gear 81 engaged with the first gear 80 and to the third gear 82 in succession, whereby the third gear 82 is rotated clockwise illustrated in FIG. 4. As illustrated in FIG. 4, when viewed in the rotation axis direction of the rotating shaft 92*a*, the axial center of rotation of the rotating shaft 92*a* is located above the blade 91 and below the axial center of rotation of the screw 92*d* in a direction of gravity.

The toner passed through the secondary transfer portion N2 and then removed from the intermediate transfer belt 71 by the blade 91 accumulates in the collection unit 92, near the cleaning portion CL where the blade 91 contacts the intermediate transfer belt 71 and near the sheet member 44. In the configuration of the present exemplary embodiment, the toner accumulating in the collection unit 92 is agitated and supplied to the screw 92*d* by the rotating sheet member 92*e*. The mechanism by which the sheet member 92*e* supplies the toner to the screw 92*d* will be described in detail below.

The screw 92*d* includes a helical conveyance portion 60 for conveying the toner supplied by the sheet member 92*e* in the direction of the arrow BB in FIG. 2 along the rotation axis direction (longitudinal direction) of the screw 92*d*. The screw 92*d* is held by a cylindrical holding portion 92*f* formed in the collection unit 92. The holding portion 92*f* extends in the rotation axis direction of the screw 92*d* and holds the screw 92*d*. To enable the toner supplied from the sheet member 92*e* to reach the conveyance portion 60 of the screw 92*d*, the holding portion 92*f* is not located in a region 92*g* (opening) opposed to the sheet member 92*e*.

The screw 92*d* includes a fourth gear 83 for drive transmission on its non-driving side end in the rotation axis direction. The fourth gear 83 is engaged with the third gear 82 for driving the sheet member 92*e*. The fourth gear 83 can be rotated by driving force transmitted via the first, second, and third gears 80, 81, and 82.

The toner accommodation unit 92*c* includes a wall portion 92*h* near the sheet member 92*e*. When viewed in the rotation axis direction of the screw 92*d*, the wall portion 92*h* has an arc shape concentric with the arc shape of the rotation orbit Rm of the sheet member 92*e*. The toner accommodation unit 92*c* also includes a wall portion 92*i* of straight shape. When viewed in the rotation axis direction of the screw 92*d*, the wall portion 92*i* extends continuously from the end edge of the wall portion 92*h* closer to the screw 92*d* toward the screw 92*d*. In the present exemplary embodiment, the wall portions 92*h* and 92*i* are members forming a frame of the toner accommodation unit 92*c*.

In the configuration of the present exemplary embodiment, the wall portion 92*h* of the toner accommodation unit 92*c* is located downstream of the cleaning portion CL and upstream of the screw 92*d* in the rotation direction of the sheet member 92*e*, when viewed in the rotation axis direction of the screw 92*d*. The wall portion 92*h* is located inside the rotation orbit Rm of the outermost peripheral portion of the screw 92*d* in terms of the radial direction of the rotation orbit Rm. When viewed in the rotation axis direction of the screw 92*d*, the region 92*g* is located downstream of the wall portion 92*h* and upstream of the cleaning portion CL in the rotation direction of the sheet member 92*e*.

A part of the urethane rubber 91*a* is located to fall within the rotation orbit Rm in the radial direction of the rotation orbit Rm. Meanwhile, the sheet member 44 is located radially outside the rotation orbit Rm of the free end of the sheet member 92*e*. With such a configuration, the sheet member 92*e* interferes with the wall portion 92*h* and a part of the blade 91 during rotation while maintaining a certain distance from the sheet member 44. Consequently, the sheet member 92*e* can efficiently agitate the toner accommodated in the toner accommodation unit 92*c* and supply the toner to the screw 92*d*.

Figure 5A:
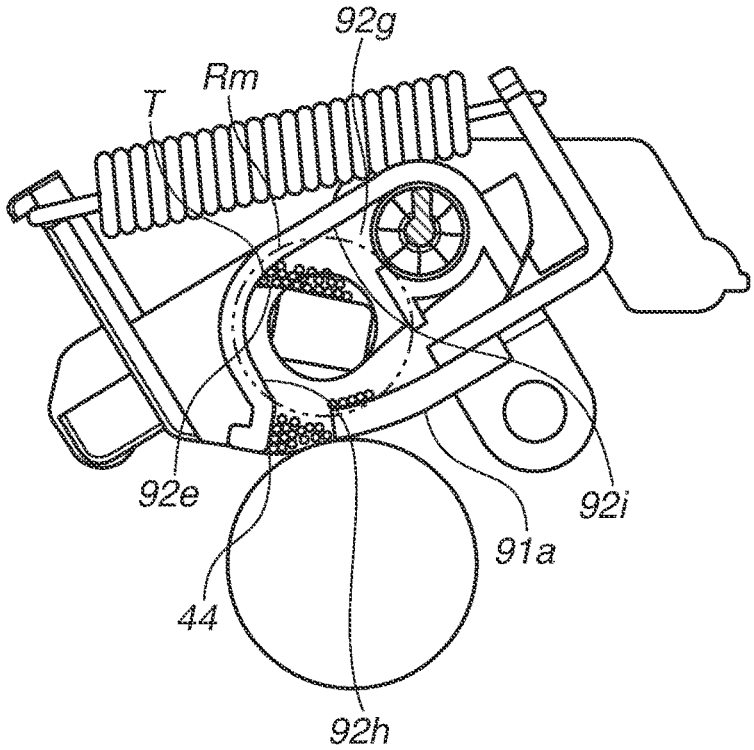
FIGS. 5A and 5B are schematic diagrams for describing conveyance of toner in the cleaning unit.
Figure 5B:
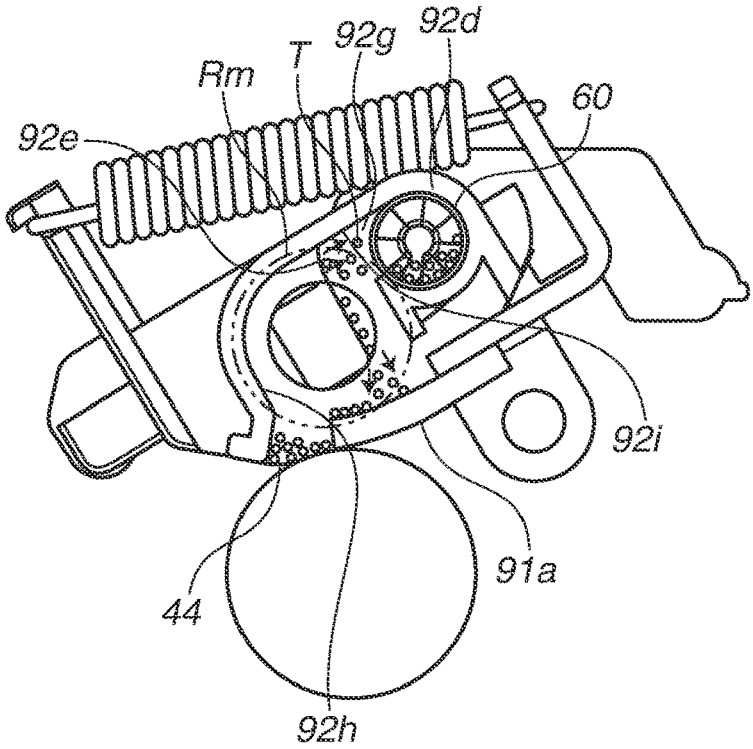

The agitation of the toner by the sheet member 92*e* and the supply of the toner to the screw 92*d* will now be described with reference to FIGS. 5A and 5B. FIG. 5A is a schematic sectional view for describing the conveyance of toner in a state where the sheet member 92*e* contacts the wall portion 92*h*, viewed in the rotation axis direction of the screw 92*d*. FIG. 5B is a schematic sectional view for describing the conveyance of toner in a state where the contact between the wall portion 92*h* and the sheet member 92*e* is released, viewed in the rotation axis direction of the screw 92*d*.

The outermost peripheral portion of the free end of the sheet member 92*e*, as described above, rotates clockwise along the rotation orbit Rm. As illustrated in FIG. 5A, a part of the upper surface portion (top surface) of the urethane rubber 91*a* in a direction of gravity is located radially inside the rotation orbit Rm; accordingly, the sheet member 92*e* rotates to interfere with the top surface of the urethane rubber 91*a*. In other words, the sheet member 92*e* scrapes the toner accumulating on the top surface of the urethane rubber 91*a* while rotating.

As illustrated in FIG. 5A, the wall portion 92*h* is located radially inside the rotation orbit Rm. The sheet member 92*e* thus scoops up the toner along the wall portion 92*h* while rotating. At this time, the toner accumulating on the sheet member 44, radially inside the rotation orbit Rm is scooped up and conveyed by the sheet member 92*e*. Meanwhile, the toner accumulating near the sheet member 44, radially outside the rotation orbit Rm remains on top of the sheet member 44 in a direction of gravity.

If toner is further collected by the blade 91 in such a state, the toner removed from the intermediate transfer belt 71 by the blade 91 pushes the toner accumulating on the sheet member 44 and a surface of the toner rises in a direction of gravity. If the toner surface reaches inside the rotation orbit Rm, the toner is scooped up by the rotating sheet member 92*e*. In such a manner, the toner accumulating on the sheet member 44 is replaced in succession.

As illustrated in FIG. 5A, the wall portion 92*h* is located radially inside the rotation orbit Rm of the free end of the sheet member 92*e*; the sheet member 92*e* is accordingly deformed upstream in the rotation direction of the sheet member 92*e* while rotating in contact with the wall portion 92*h*. More specifically, the sheet member 92*e* rotates in a deformed state (first state) where an end of the sheet member 92*e* (free end) contacting the wall portion 92*h* is deformed upstream in the rotation direction of the sheet member 92*e*. The toner is thereby scooped up as illustrated in FIG. 5A in a state of being prevented from falling from the sheet member 92*e*.

As illustrated in FIG. 5B, the free end is separated from the wall portion 92*h* when the free end of the sheet member 92*e* moves from the wall portion 92*h* to the position of the wall portion 92*i*. This brings the sheet member 92*e* into a free state (second state) where the deformation of the end (free end) having been in contact with the wall portion 92*h* is released. At this time, some of the toner T scooped up by the sheet member 92*e* flies from the sheet member 92*e* toward the screw 92*d* via the region 92*g* because of the reaction of the sheet member 92*e* to return from the deformed state illustrated in FIG. 5A to the free state in FIG. 5B. The flying toner T reaches the screw 92*d*, and then the toner T is conveyed toward the toner conveyance path 761 by the conveyance portion 60 of the rotating screw 92*d*. Toner not flown by the reaction of the sheet member 92*e* returning to the free state falls on the top surface of the urethane rubber 91*a* as illustrated by the arrow in FIG. 5B. The tonner is then scooped up again by the rotating sheet member 92*e*.

The toner T is conveyed in the direction of the arrow BB in FIG. 2 along the rotation axis direction of the screw 92*d* by the conveyance portion 60. The toner T then reaches the toner conveyance path 761. As illustrated in FIG. 3, the toner conveyance path 761 is formed with a slope angle greater than or equal to an angle at which the toner T falls by its own weight. The toner T conveyed to the toner conveyance path 761 by the rotation of the screw 92*d* is thus conveyed to an inlet 763 of the collection container 75 by the toner's own weight.

The toner T conveyed to the inlet 763 is dispersed and filled into the collection container 75 by a not-illustrated toner dispersion member, which is located in the collection container 75 to fill the toner into the collection container 75. Examples of the toner dispersion member include a member, such as a screw and a paddle, having a helical conveyance portion and conveying the toner by rotation. Other examples include an arm member and a slide member that can disperse toner by axial extension and contraction.

As described above, according to the present exemplary embodiment, the toner collected from the intermediate transfer belt 71 into the collection unit 92 by the blade 91 can be agitated and supplied to the screw 92*d* located above the blade 91 in a direction of gravity by the sheet member 92*e*. More specifically, the toner accommodation unit 92*c* includes the wall portion 92*h* located inside the rotation orbit Rm of the outermost peripheral portion of the sheet member 92*e* when viewed in the rotation axis direction of the screw 92*d*. The sheet member 92*e*, when rotating in contact with the wall portion 92*h*, scoops up and conveys the toner with the free end deformed. If the sheet member 92*e* is separated from the wall portion 92*h* and the deformed state of the sheet member 92*e* is released, the toner scooped up by the sheet member 92*e* flies toward the screw 92*d* because of the reaction of the sheet member 92*e* returning from the deformed state to the free state. According to the configuration of the present exemplary embodiment, the toner accommodated in the toner accommodation unit 92*c* can thus be efficiently agitated and conveyed toward the screw 92*d*. This can prevent a drop in the cleaning performance of the cleaning unit 9.

Figure 6A:
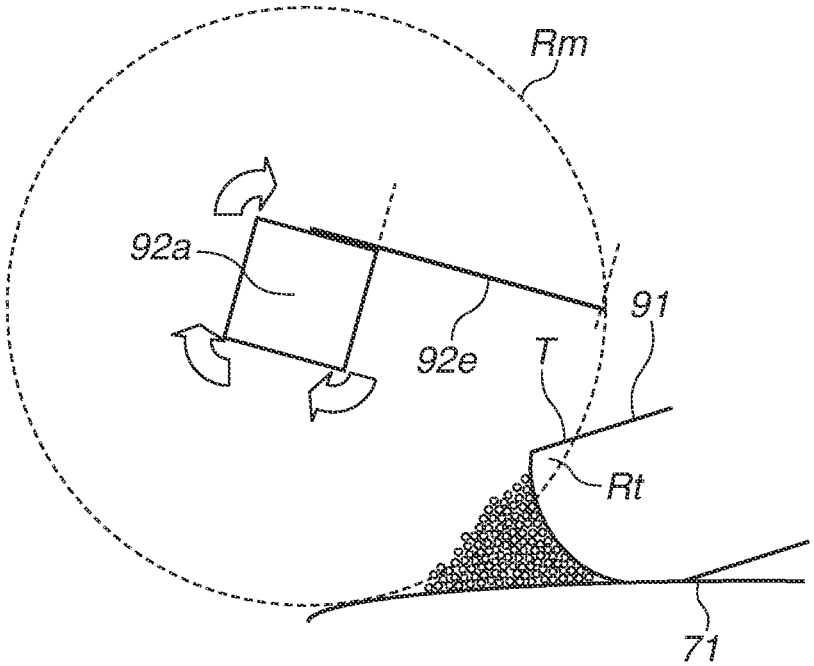
FIGS. 6A and 6B are schematic diagrams for describing a relationship between an agitation member and a collection member.
Figure 6B:
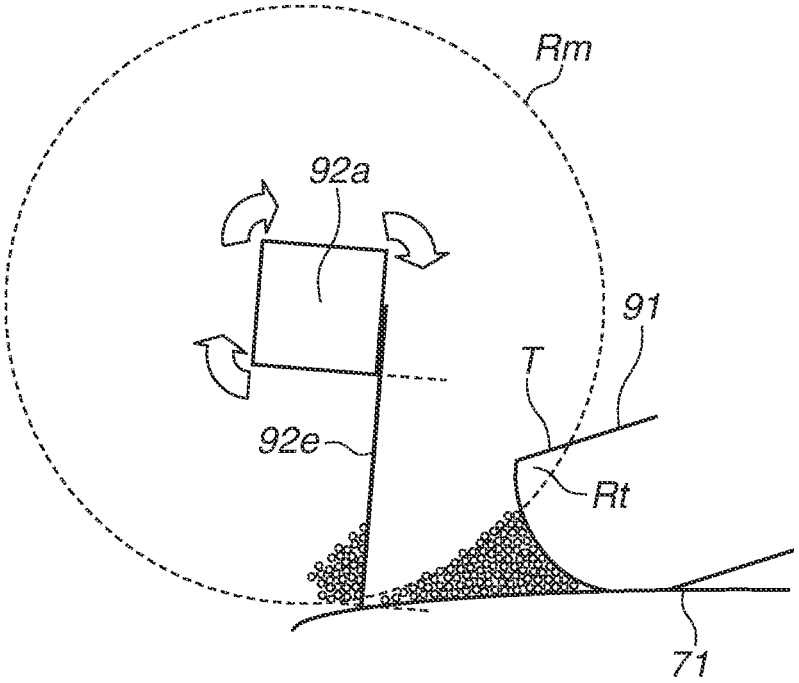

FIG. 6A is a schematic sectional view for describing a state before the toner near the cleaning portion CL is scraped by the sheet member 92*e*, viewed in the rotation axis direction of the rotating shaft 92*a*. FIG. 6B is a schematic sectional view for describing a state after the toner near the cleaning portion CL is scraped by the sheet member 92*e*, viewed in the rotation axis direction of the rotating shaft 92*a*.

As illustrated in FIG. 6A, in the present exemplary embodiment, the members are located such that the region formed by the rotation orbit Rm of the sheet member 92*e* overlaps the blade 91 when viewed in the rotation axis direction of the rotating shaft 92*a*. In other words, when viewed in the rotation axis direction of the rotating shaft 92*a*, at least a part of the region (in the present exemplary embodiment, region Rt) on the free end side of the blade 91 in the belt conveyance direction overlaps the region formed by the rotation orbit Rm. As illustrated in FIG. 6B, part of the toner accumulating near the blade 91 is thereby conveyed by the sheet member 92*e* and supplied to the screw 92*d* as the sheet member 92*e* rotates.

In the present exemplary embodiment, the blade 91 and the sheet member 92*e* are configured to contact each other. The sheet member 92*e* is made of a soft member such as a PET sheet. These configurations can maximize the use of the toner conveyance region of the sheet member 92*e* while minimizing the impact of the contact between the blade 91 and the sheet member 92*e*.

If the sheet member 92*e* is located too close to the blade 91, a length of the portion of the sheet member 92*e* contacting the blade 91 increases. A contact time of the sheet member 92*e* increases, and the sheet member 92*e* is bent more greatly during the contact. The pressure applied to the blade 91 by the rotation of the sheet member 92*e* then increases, and the impact on the blade 91 can increase to cause a drop in the cleaning performance, accordingly. In the present exemplary embodiment, a contact length of a contact region T of the blade 91 over which the sheet member 92*e* makes contact during the rotation of the sheet member 92*e* is set to 1 mm. The contact length of the contact region T is referred to as a length of the blade 91 in a direction intersecting the longitudinal direction of the blade 91 parallel to the width direction of the intermediate belt 110, viewed in the rotation axis direction of the rotating shaft 92*a*. To avoid the foregoing drop in the cleaning performance, the contact length of the contact region T may desirably be set to 2 mm or less.

In the image forming apparatus 100 according to the present exemplary embodiment, the transfer material P is conveyed to the secondary transfer portion N2 vertically upward in a direction of gravity. In the present exemplary embodiment, as illustrated in FIG. 1, the cleaning unit 9 is located above the driving roller 72 in a direction of gravity. However, the conveyance direction of the transfer material P and the member opposed to the cleaning unit 9 are not limited to those described in the present exemplary embodiment. Similar effects can be obtained by using the configuration of the present exemplary embodiment at least as long as the configuration includes the cleaning unit 9 where the screw 92*d* is located above the cleaning portion CL in a direction of gravity.

In the image forming apparatus 100 according to the present exemplary embodiment, the intermediate transfer belt 71, the cleaning unit 9, and the collection container 75 are integrated as an intermediate transfer unit 7 that is detachably attachable to the apparatus main body of the image forming apparatus 100. However, this is not restrictive. The intermediate transfer unit 7 and the collection container 75 may be configured as separate units. The intermediate transfer unit 7 and the collection container 75 may be configured to be independently replaceable with respect to the apparatus main body of the image forming apparatus 100.

In the present exemplary embodiment, the components included in the cleaning unit 9 configured to collect the toner remaining on the intermediate transfer belt 71 serving as an image bearing member have been described. However, this configuration is not limited thereto. The components described in the present exemplary embodiment can be used for a cleaning unit that collects toner remaining on a photosensitive drum serving as an image bearing member. In such a case, the image forming apparatus including the cleaning unit having the configuration described in the present exemplary embodiment may be configured such that a toner image is transferred from the photosensitive drum to an intermediate transfer member, such as an intermediate transfer belt, or a toner image is transferred from the photosensitive drum to a transfer material, such as a sheet of paper. In either case, similar effects can be obtained by the use of a similar configuration to that of the present exemplary embodiment.

A second exemplary embodiment will be described below with reference to FIGS. 7A to 14C. In the following description, similar components and controls to those of the first exemplary embodiment are denoted by the same reference numerals, and a description thereof will be omitted. Only differences from the first exemplary embodiment will be described in detail.

[Cleaning Unit]

Figure 7A:
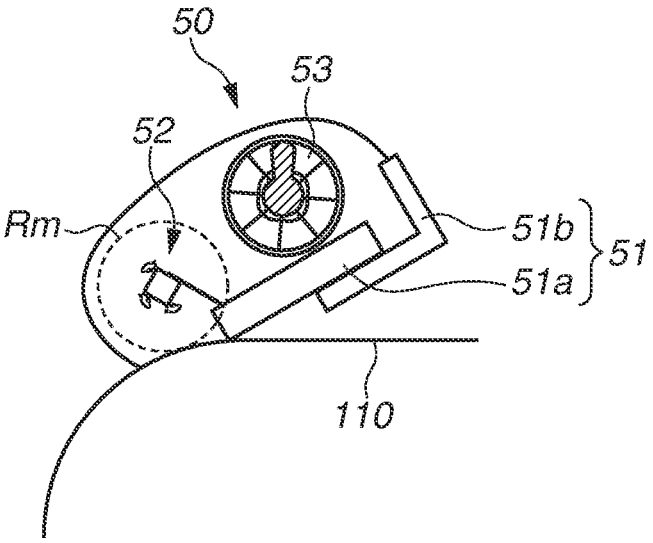
FIGS. 7A, 7B, and 7C are schematic diagrams for describing a configuration of a cleaning unit according to a second exemplary embodiment.
Figure 7B:
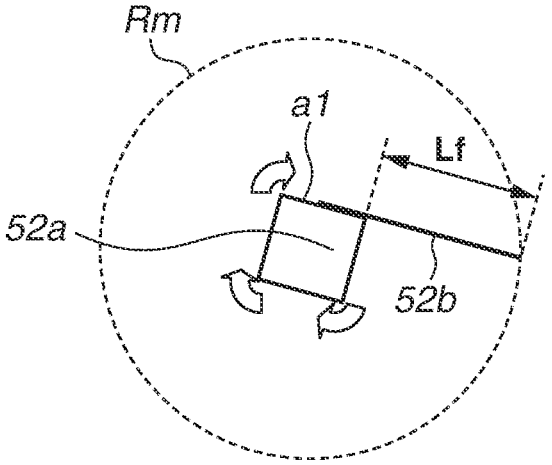
Figure 7C:
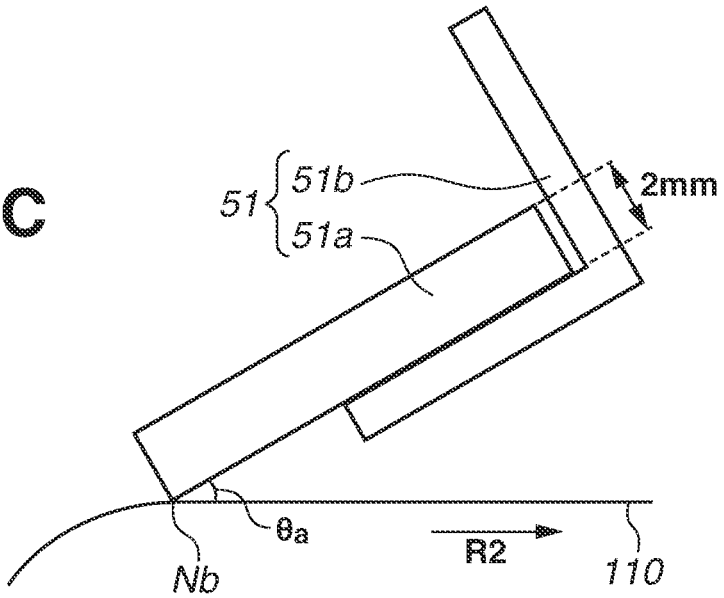

FIG. 7A is a schematic sectional view for describing a configuration of a cleaning unit 50 according to the present exemplary embodiment. FIG. 7B is a schematic diagram for describing a configuration of an agitation member 52 included in the cleaning unit 50. FIG. 7C is a schematic diagram for describing a state of contact between a blade 51 included in the cleaning unit 50 and an intermediate transfer belt 110. The blade 51 according to the present exemplary embodiment is a plate-like member long in a width direction (longitudinal direction of the blade 51) of the intermediate transfer belt 110 intersecting the moving direction of the intermediate transfer belt 110 (hereinafter, referred to as a belt conveyance direction).

As illustrated in FIG. 7A, the cleaning unit 50 includes an agitation member 52 and a screw 53. The agitation member 52 agitates toner collected by the blade 51. The screw 53 serves as a conveyance member for conveying the toner collected by the blade 51 in the longitudinal direction of the blade 51. The agitation member 52 and the screw 53 are located to extend continuously over substantially the entire area inside the frame of the cleaning unit 50 in the longitudinal direction of the blade 51. The screw 53 rotates by receiving a driving force from a not-illustrated driving source, and thereby can convey the toner. In the present exemplary embodiment, a mold screw having an outer diameter of 10 mm is used as the screw 53.

As illustrated in FIG. 7B, the agitation member 52 includes a rotating shaft 52*a* and a sheet member 52*b*. The rotating shaft 52*a* rotates by receiving a driving force transmitted from a not-illustrated driving source. The sheet member 52*b* is a flexible sheet member, such as a PET sheet, having a thickness of approximately 80 μm. The sheet member 52*b* is fixed to the rotating shaft 52*a* and can be rotated by the rotating shaft 52*a*. The rotating shaft 52*a* is made of a resin member having a length of 250 mm in the longitudinal direction of the blade 51. The rotating shaft 52*a* includes at least one flat portion al parallel to the longitudinal direction of the blade 51.

One end of the sheet member 52*b* is fixed to the flat portion al with, for example, a two-sided adhesive tape (not illustrated). More specifically, when viewed in the rotation axis direction of the rotating shaft 52*a*, one end of the sheet member 52*b* in the radial direction of a rotation orbit Rm of the sheet member 52*b* is fixed to the flat portion al. The other end opposite to the one end is a free end. In the present exemplary embodiment, the length of the portion of the sheet member 52*b* not fixed to the flat portion al (free length Lf) is 5 mm. The rotation orbit Rm refers to a rotation orbit of an outermost peripheral portion of the agitation member 52, i.e., a rotation orbit of an extremity of the free end of the sheet member 52*b*. In the present exemplary embodiment, as illustrated in FIG. 7A, at least a part of an elastic portion 51*a* of the blade 51 on the free end side is located inside the circular region formed by the rotation orbit Rm.

Toner collected from the intermediate transfer belt 110 by the blade 51 accumulates near the blade 51. The collected toner is then supplied to the screw 53 by the rotation of the agitation member 52. Thereafter, the toner is conveyed to a collection container (not illustrated) for collecting toner by the rotation of the screw 53. The conveyance of the toner collected by the blade 51 in the cleaning unit 50 will be described in detail below.

<Configuration of Blade>

As illustrated in FIG. 7C, the blade 51 according to the present exemplary embodiment includes the elastic portion 51*a* that contacts the intermediate transfer belt 110 and scrapes off toner, and a metal plate portion 51*b* that supports the elastic portion 51*a*. The elastic portion 51*a* is made of polyurethane. The blade 51 includes the elastic portion 51*a* contacting the intermediate transfer belt 110 and having a blade shape of 245 mm in width. The elastic portion 51*a* is bonded to the metal plate portion 51*b*. The elastic portion 51*a* of the blade 51 has a longitudinal length (width) of 245 mm in a width direction orthogonal to the moving direction of the intermediate transfer belt 110, and a thickness of 2 mm. The free length Lf, which is the length of the free end from the bonding point with the metal plate portion 51*b*, is 15 mm. The blade 51 has a hardness of 77 degrees according to Japanese Industrial Standard (JIS) K 6253.

As similar to FIG. 1, a counter roller (the driving roller 72) is located on the inner peripheral side of the intermediate transfer belt 110, opposite to the blade 51. The blade 51 contacts the surface of the intermediate transfer belt 110 in a counter direction with respect to the belt conveyance direction, at a position opposed to the counter roller. More specifically, the elastic portion 51*a* of the blade 51 contacts the surface of the intermediate transfer belt 110 such that its end on the free end side in the lateral direction is directed upstream in the belt conveyance direction. The free end side of the elastic portion 51*a* refers to where the elastic portion 51*a* contacts the intermediate transfer belt 110. In other words, the free end side of the elastic portion 51*a* refers to the other end side opposite to the one end side where the elastic portion 51*a* is fixed to the metal plate portion 51*b* in terms of the lateral direction of the elastic portion 51*a* when viewed in a belt width direction orthogonal to the belt conveyance direction. As illustrated in FIG. 7C, a blade nip portion Nb is formed at a position where the blade 51 contacts the intermediate transfer belt 110.

In the present exemplary embodiment, the blade 51 is located with respect to the intermediate transfer belt 110 at a setting angle $\theta_a$ of 20° and with an amount of intrusion δ of 2.0 mm. As employed herein, the setting angle $\theta_a$ is an angle that is formed by the blade 51 (more specifically, one surface substantially orthogonal to the thickness direction thereof) and a tangent line to the counter roller at an intersection of the intermediate transfer belt 110 and the blade 51 (more specifically, the end face of the free end thereof). The amount of intrusion δ is the length in the thickness direction in which the blade 51 stacks with respect to the counter roller. A contact pressure is defined by a pressing force (longitudinal linear pressure) applied to the blade nip portion Nb from the blade 51, and measured by using a film-type pressure measurement system (product name: PINCH, manufactured by Nitta Corporation). With such settings, turning-up and slipping sound of the blade 51 in a high-temperature high-humidity environment can be prevented to obtain favorable cleaning performance.

[Intermediate Transfer Belt]

Figure 8A:
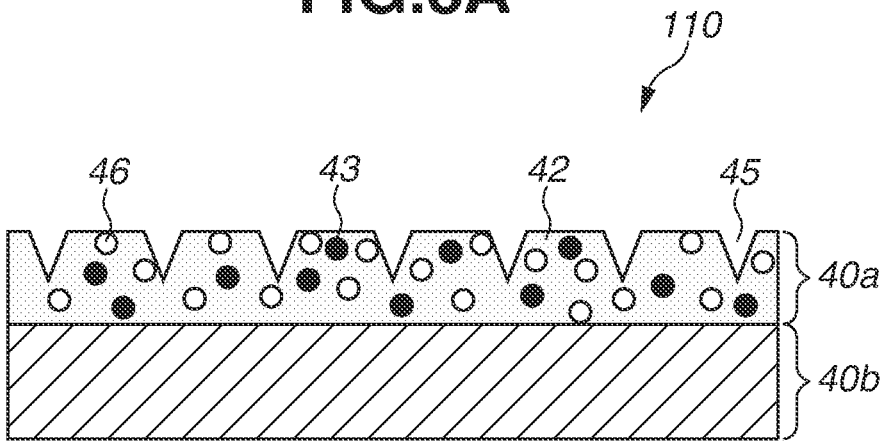
FIGS. 8A and 8B are schematic diagrams for describing a configuration of a belt according to the second exemplary embodiment.
Figure 8B:
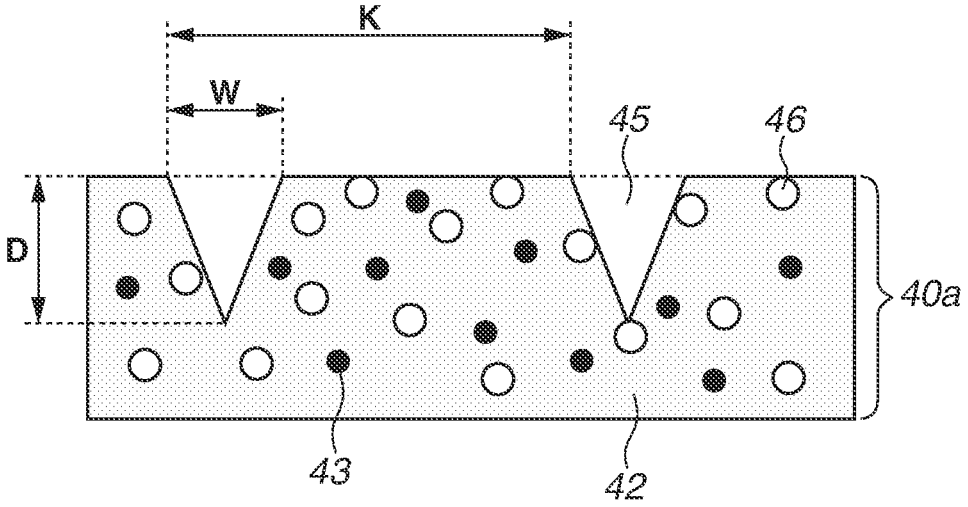

FIG. 8A is a schematic enlarged partial sectional view of the intermediate transfer belt 110, taken in a direction substantially orthogonal to the belt conveyance direction (viewed along the belt conveyance direction). FIG. 8B is a detailed view of a surface layer 40*a* of the intermediate transfer belt 110 to be described below in a similar cross section.

The intermediate transfer belt 110 according to the present exemplary embodiment is an endless belt member (or film member) having a circumferential length of 700 mm and a longitudinal width of 250 mm. The intermediate transfer belt 110 includes two layers, a base layer 40*b* and the surface layer 40*a*. As employed herein, the base layer 40*b* is defined as the thickest layer in the thickness direction of the intermediate transfer belt 110 among the layers constituting the intermediate transfer belt 110. The surface layer 40*a* is the layer contacting the photosensitive drums 1*a* to 1*d* and the blade 51, and is located on the outer peripheral side of the intermediate transfer belt 110.

The base layer 40*b*, which is illustrated in FIG. 8A, of the intermediate transfer belt 110 is an endless PET resin layer having a thickness of 60 μm, with an ion conductive agent mixed therein as a conductive agent. The intermediate transfer belt 110 has ion conductivity as an electrical characteristic. Since propagation of ions between polymer chains provides electrical conductivity, the intermediate transfer belt 110 is characterized by low circumferential unevenness in resistance, with modest resistance variations with temperature and humidity in the ambient environment. The surface layer 40*a* is made of an acrylic resin (base material 42) and formed on the surface of the base layer 40*b*. In the present exemplary embodiment, the surface layer 40*a* has a thickness of 3 μm. The base material 42 of the surface layer 40*a* contains a conductive agent 43 and a solid lubricant 46, and has a function of adjusting the resistance of the intermediate transfer belt 110 and keeping toner attracted to the surface layer 40*a*.

In the present exemplary embodiment, a base layer 40*b* having a volume resistivity of $1\times10^8$ Ω·cm or less is used to reduce a drop in the voltage of the intermediate transfer belt 110. The volume resistivity was measured with Hiresta-UP (MCP-HT450) and a ring probe type UR (model: MCP-HTP12) manufactured by Mitsubishi Chemical Corporation. The measurement was conducted under the conditions of a room temperature of 23° C., a room humidity of 50%, an applied voltage of 100 V, and a measurement time of 10 sec.

The materials of the base layer 40*b* and the surface layer 40*a* are not limited to the foregoing, and other materials may be used. Examples of the material of the base layer 40*b* other than polyethylene naphthalate resins include thermoplastic resins such as polycarbonate, polyvinylidene difluoride (PVDF), polyethylene, polypropylene, polymethylpentene-1, polystyrene, polyamide, polysulfone, polyarylate, PET, polybutylene terephthalate, polyphenylene sulfide, polyether sulfone, polyether nitrile, thermoplastic polyimide, polyether ether ketone, thermotropic liquid crystal polymer, and polyamic acid. A mixture of two or more of such materials can also be used.

Examples of organic materials of the surface layer 40*a* other than acrylic resins include curable resins such as melamine resins, urethane resins, alkyd resins, and fluorine-based curable resins (fluorine-containing curable resins). Examples of inorganic materials include alkoxy silane- and alkoxy zirconium-based materials, and silicate-based materials. Examples of organic-inorganic hybrid materials include inorganic particle-dispersed organic polymer materials, inorganic particle-dispersed organo alkoxysilane-based materials, acrylic silicon-based materials, and organo alkoxysilane-based materials.

As illustrated in FIGS. 8A and 8B, a surface treatment is applied, in the present exemplary embodiment, to the surface layer 40*a* to reduce a drop in cleaning performance. Specifically, grooves (groove shapes, groove portions) 45 are formed along the belt conveyance direction.

As illustrated in FIG. 8B, the grooves 45 have an opening width W (hereinafter, referred to simply as a width W) of 2 μm in the direction substantially orthogonal to the belt conveyance direction (the width direction of the intermediate transfer belt 110). A depth D from the surface of the surface layer 40*a* where no groove is formed (opening portion) to the bottom of a groove 45 in the thickness direction of the intermediate transfer belt 110 (hereinafter, referred to simply as a depth D) is 2 μm. A distance K between the grooves 45 in the direction substantially orthogonal to the belt conveyance direction (hereinafter, referred to simply as a pitch K) is 20 μm. In view of the cleaning performance, the pitch K is desirably set to 10 μm to 100 μm, typically 10 μm to 20 μm.

In view of the cleaning performance, the width W of the grooves 45 is desirably up to approximately one-half the average particle size of the toner. If the grooves 45 have too large a width W, toner caught in the grooves 45 can slip through the blade nip portion Nb to cause a cleaning failure. If the grooves 45 have too small a width W, the contact area between the blade 51 and the intermediate transfer belt 110 becomes so large that the friction in the blade nip portion Nb can increase to accelerate wear of the tip of the elastic portion 51*a* of the blade 51. In the configuration of the present exemplary embodiment, the width W of the grooves 45 is therefore desirably set to 0.5 μm or more and not more than 3 μm.

In the present exemplary embodiment, the surface layer 40*a* has a thickness of 3 μm, and thereby the grooves 45 are located only within the surface layer 40*a* without reaching the base layer 40*b*. The grooves 45 are continuously formed over the entire circumference of the intermediate transfer belt 110 along the circumferential direction (rotation direction) of the intermediate transfer belt 110. In the present exemplary embodiment, the groove shapes are formed in the surface of the intermediate transfer belt 110 by pressing a die having protruding shapes on its surface against the surface layer 40*a*.

The grooves 45 can be formed in the surface of the intermediate transfer belt 110 by using a unit, such as a polishing unit, a cutting unit, and an imprinting unit. In the present exemplary embodiment, the intermediate transfer belt 110 having the grooves 45 in the surface can be obtained by selecting and using an appropriate unit from such forming units. Of these, an imprinting unit is suitably used in view of machining cost and productivity. The imprinting unit makes use of the photocurability of an acrylic resin serving as a base material of the micromachined surface. Alternatively, a cured acrylic resin may be lapped to form the grooves 45. In such a case, the groove shapes can be formed in the surface of the intermediate transfer belt 110 by using a lapping film (Lapika #2000 (product name), manufactured by KOVAX Corporation). The lapping film contains uniformly-dispersed fine abrasive particles, and thus lapping film can form a uniform pattern without deep scratches or polishing unevenness.

In the present exemplary embodiment, the grooves 45 are formed in the surface of the intermediate transfer belt 110 by an imprinting process. The imprinting process includes pressing a die having a fine emboss pattern against the surface layer 40*a* of the intermediate transfer belt 110 to transfer the fine emboss pattern of the die to the surface of the intermediate transfer belt 110. In the present exemplary embodiment, the grooves 45 are formed over the entire circumference of the intermediate transfer belt 110 along the moving direction of the intermediate transfer belt 110.

Figure 9A:
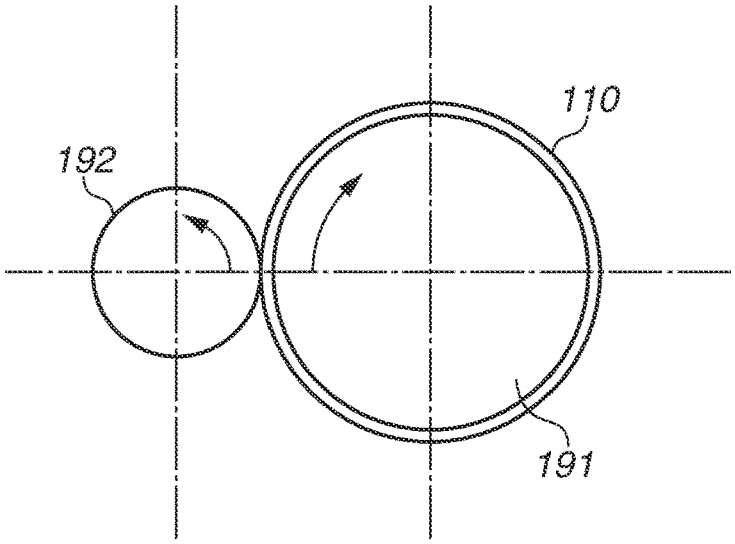
FIGS. 9A, 9B, and 9C are schematic diagrams for describing a method for forming grooves in the belt according to the second exemplary embodiment.
Figure 9B:
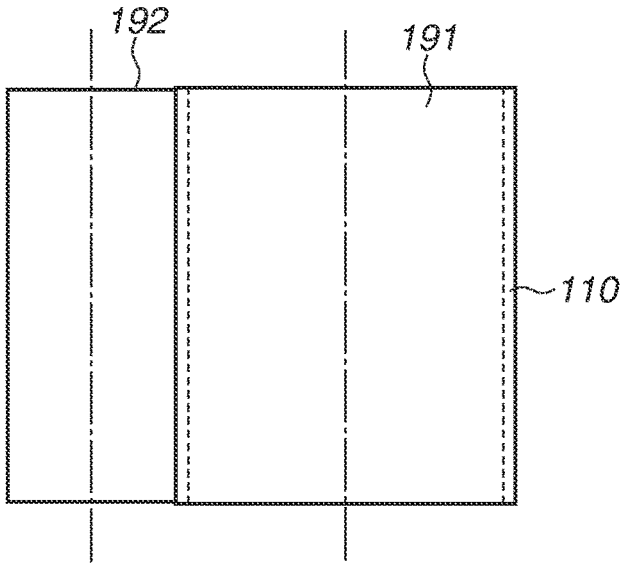
Figure 9C:
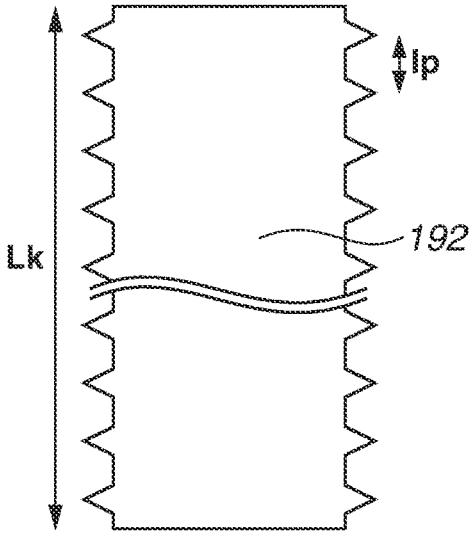

Details of the imprinting process according to the present exemplary embodiment will now be described in detail with reference to FIGS. 9A to 9C. FIG. 9A is a schematic diagram illustrating the imprinting unit as viewed from above in the direction of the cylindrical axis of the intermediate transfer belt 110. FIG. 9B is a schematic sectional view of the imprinting unit, taken along a direction parallel to the cylindrical axis of the intermediate transfer belt 110. FIG. 9C is a sectional view of a die 192 used in the imprinting process.

To form the grooves 45 by imprinting, the intermediate transfer belt 110 with an intact surface layer 40*a* on the base layer 40*b* is press-fit onto a core 191 (227 mm in diameter, made of carbon tool steel). The die 192 of cylindrical shape, having a diameter of 50 mm and a length of 250 mm, is pressed against the surface of the press-fit intermediate transfer belt 110 with a predetermined pressing force, in which state the core 191 is rotated to machine the entire area of the intermediate transfer belt 110 across the longitudinal width of 250 mm.

In a case of forming the grooves 45 in the intermediate transfer belt 110, the die 192 is heated by a not-illustrated heater to a temperature of 130° C., which is 5° C. to 15° C. higher than the glass transition temperature of polyethylene naphthalate. With the heated die 192 in contact with the intermediate transfer belt 110, the core 191 is rotated around at a circumferential speed of 264 mm/s. The die 192 is then separated from the intermediate transfer belt 110. While the core 191 rotates, the die 192 is driven to rotate by the rotation of the core 191. In the present exemplary embodiment, the grooves 45 are formed in the surface layer 40*a* of the intermediate transfer belt 110 by machining the surface shape as described above.

As illustrated in FIG. 9C, a die of Lk in length, having triangular protrusions formed on its surface at regular intervals of Ip in parallel with the circumferential direction of the cylinder, is used as the die 192 according to the present exemplary embodiment. In the present exemplary embodiment, the interval Ip is 20 μm and the length Lk is 250 mm. The triangular protrusions are formed by cutting such that the protrusions have a bottom length of 2.0 μm and a height of 2.0 μm. By performing the foregoing imprinting processing using the die 192 of this shape, the intermediate transfer belt 110 having the surface shape illustrated in FIGS. 8A and 8B can be obtained.

[Collection of Toner with Cleaning Unit]

The provision of the groove shapes in the intermediate transfer belt 110 can reduce the contact area between the blade 51 and the intermediate transfer belt 110 to improve the wear resistance of the blade 51. This can reduce a drop in the cleaning performance during long term operation of the image forming apparatus 100.

Figure 10A:
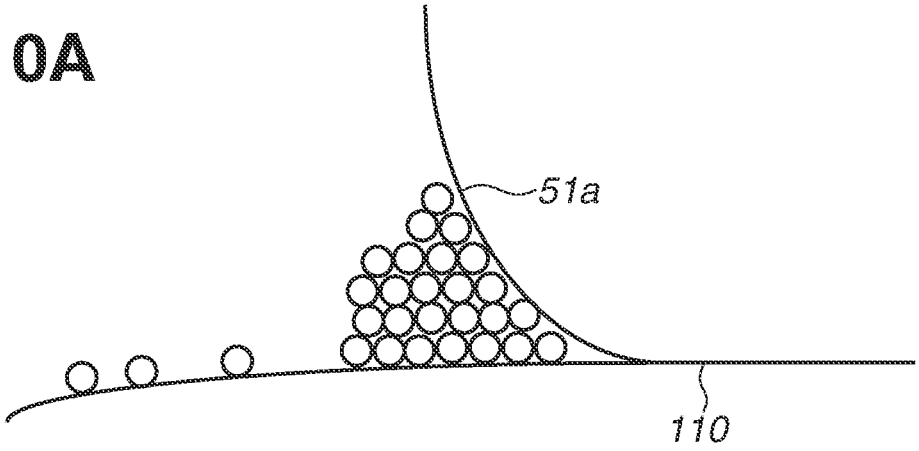
FIGS. 10A, 10B, and 10C are schematic diagrams for describing small displacements of a collection member according to the second exemplary embodiment.
Figure 10B:
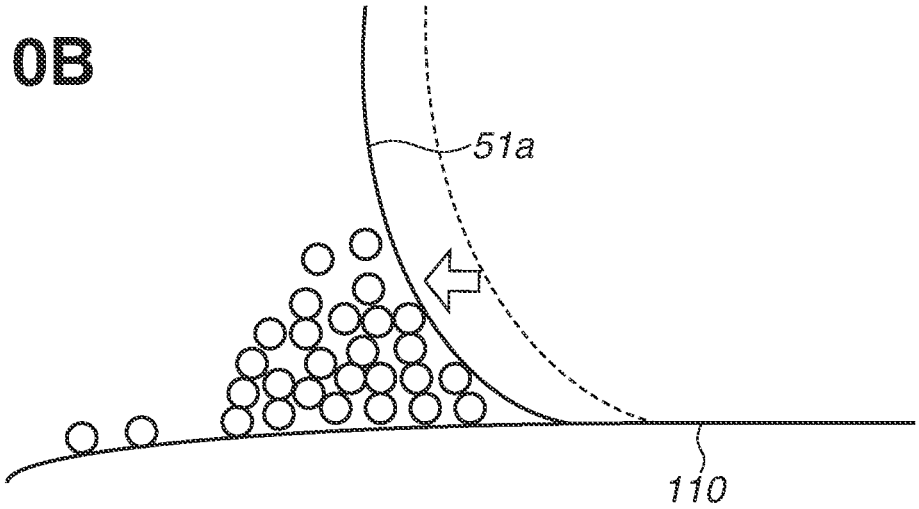
Figure 10C:
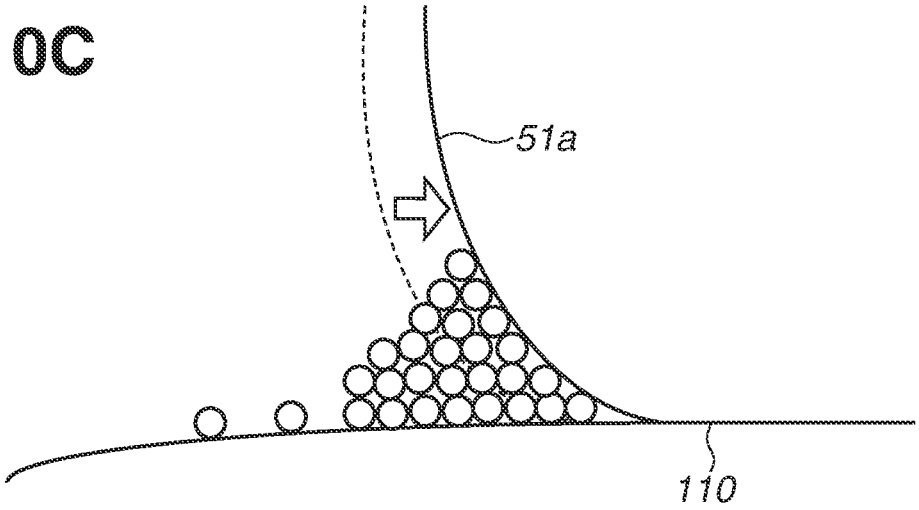

The provision of the groove shapes in the intermediate transfer belt 110 also enables the blade 51 to make small changes in orientation (small displacements) during the rotating operation of the intermediate transfer belt 110, between locations where the grooves 45 are formed and where not. A description will be given below with reference to FIGS. 10A to 10C, 11, and 12. FIGS. 10A to 10C are schematic diagrams for describing the behavior of toner reaching a position where the intermediate transfer belt 110 contacts the blade 51 according to the present exemplary embodiment.

As illustrated in FIG. 10A, the toner passed through the secondary transfer portion N2 and remaining on the intermediate transfer belt 110 is stopped by the elastic portion 51*a* in the blade nip portion Nb where the intermediate transfer belt 110 contacts the blade 51, and accumulates near the blade 51. If the toner accumulating in such a state increases, the accumulated toner can be compressed. In the configuration of the present exemplary embodiment, as illustrated in FIGS. 10B and 10C, the leading edge of the blade 51 can make small displacements as the intermediate transfer belt 110 rotates. This can loosen the toner accumulating near the blade nip portion Nb.

More specifically, the blade 51 has the shape illustrated in FIG. 10A at positions where no groove 45 is formed. In contrast, the blade 51 has the shape illustrated in FIG. 10B at positions where the grooves 45 are formed. That is, at the positions where the grooves 45 are formed, the leading edge of the blade 51 is released from the contact with the intermediate transfer belt 110 and makes small displacements in a direction (the direction of the arrow illustrated in FIG. 10B) opposite to the belt conveyance direction, unlike the positions where no groove 45 is formed.

Figure 11:
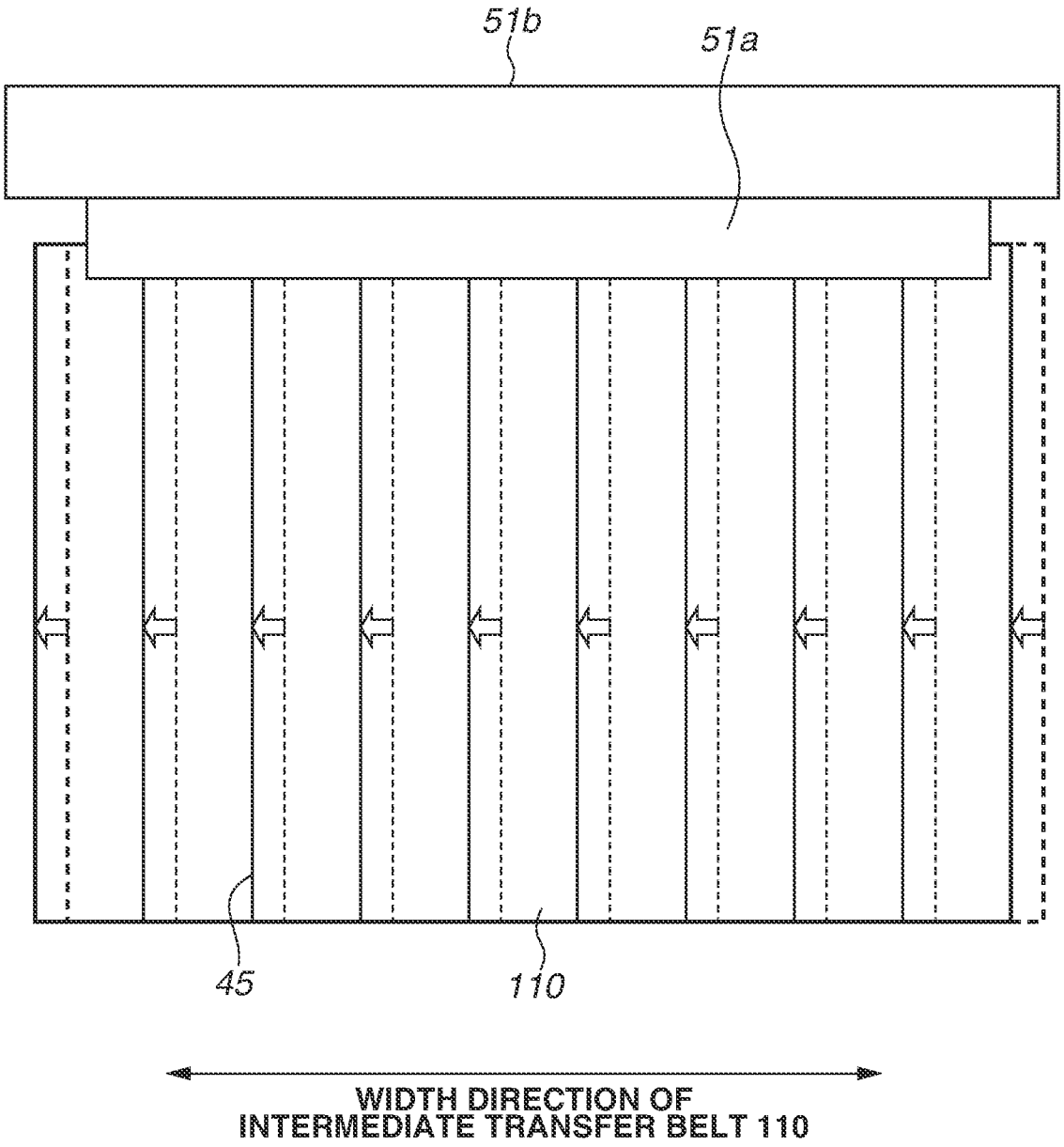
FIG. 11 is a schematic diagram for describing a relationship between the grooves and the collection member according to the second exemplary embodiment.

In the meantime, the intermediate transfer belt 110 is conveyed with slight displacements in the width direction of the intermediate transfer belt 110. FIG. 11 is a schematic diagram for describing a positional relationship between the blade 51 and the intermediate transfer belt 110 in the width direction of the intermediate transfer belt 110 in a case where the intermediate transfer belt 110 moves from the position illustrated by the dotted lines to the position illustrated by the full lines in the direction of the arrows illustrated in the diagram. As illustrated in FIG. 11, if the intermediate transfer belt 110 moves in the direction of the arrows in the diagram during a rotational moving operation, the contact positions between the grooves 45 and the elastic portion 51*a* of the blade 51 change. In other words, according to the configuration of the present exemplary embodiment, if the intermediate transfer belt 110 moves to rotate with displacements in the width direction of the intermediate transfer belt 110, the entire area of the elastic portion 51*a* in the width direction of the intermediate transfer belt 110 can contact the grooves 45.

As the intermediate transfer belt 110 moves to rotate, the elastic portion 51*a* can thus take both the state of FIG. 10A at positions where no groove 45 is formed and the state of FIG. 10B at positions where the grooves 45 are formed. More specifically, as the intermediate transfer belt 110 moves to rotate with displacements as described above, the elastic portion 51*a* makes small displacements from the state of FIG. 10B at positions opposed to where the grooves 45 are formed to the state of FIG. 10C at positions opposed to where no groove 45 is formed. Repeating such small displacements during conveyance of the intermediate transfer belt 110 can loosen the toner accumulating near the blade nip portion Nb.

In such a manner, the formation of the grooves 45 in the surface of the intermediate transfer belt 110 enables the leading edge of the elastic portion 51*a* to make small displacements, whereby the toner accumulating near the blade nip portion Nb can be loosened. However, if the amount of toner accumulating near the blade nip portion Nb continues to increase, a phenomenon that the toner is gradually compressed by the increasing pressure on the accumulated toner can occur.

In the present exemplary embodiment, the toner loosened by the small displacements of the elastic portion 51*a* is conveyed to the screw 53 by rotation of the agitation member 52, whereby the occurrence of the phenomenon that the toner accumulating near the blade nip portion Nb is compressed is prevented. A detailed description will be given below with reference to FIGS. 12A to 12C.

Figure 12A:
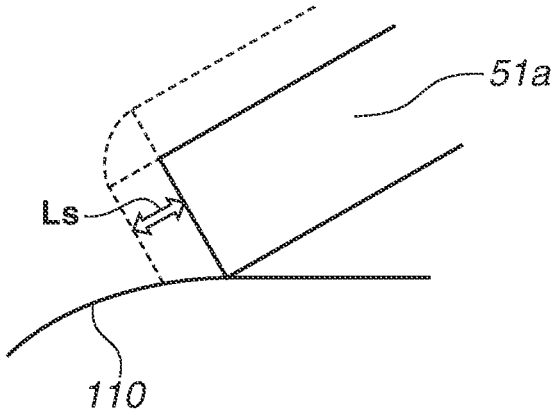
FIGS. 12A, 12B, and 12C are schematic diagrams for describing collection of toner according to the second exemplary embodiment.
Figure 12B:
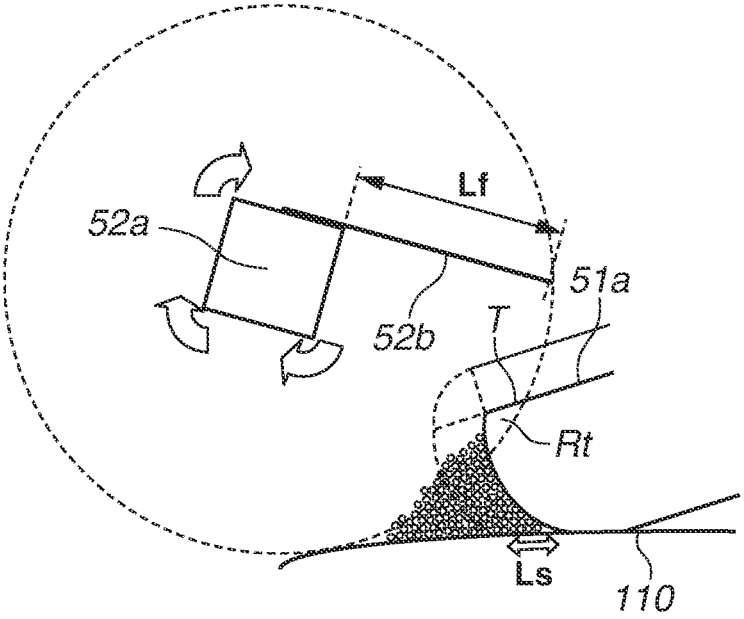
Figure 12C:
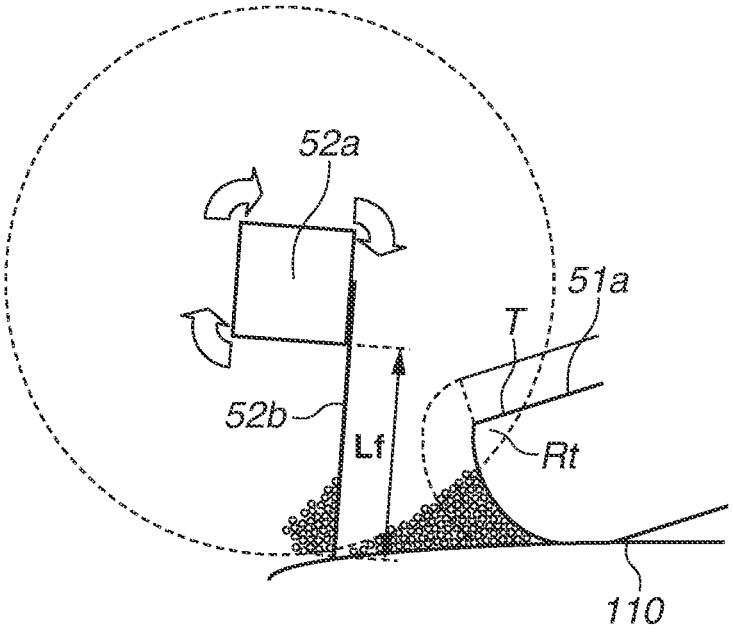

FIG. 12A is a schematic sectional view for describing the range of toner loosened by the small displacements of the blade 51. FIG. 12B is a schematic sectional view for describing a state before the toner near the blade nip portion Nb is scraped by the agitation member 52, viewed in the rotation axis direction of the rotating shaft 52*a*. FIG. 12C is a schematic sectional view for describing a state after the toner near the blade nip portion Nb is scraped by the agitation member 52, viewed in the rotation axis direction of the rotating shaft 52*a*.

As describe above, the toner accumulating near the blade nip portion Nb is loosened by the small displacements made by the edge of the free end of the elastic portion 51*a* as the intermediate transfer belt 110 moves to rotate. At this time, the small displacements of the blade 51 loosen the toner located in a region within a range of Ls in the belt conveyance direction from the edge of the elastic portion 51*a* contacting the accumulated toner when viewed in the rotation axis direction of the rotating shaft 52*a*. The range Ls is determined by the pitch K of the grooves 45, the contact pressure of the blade 51 against the intermediate transfer belt 110, the setting angle $\theta_a$ of the blade 51, and the moving speed of the intermediate transfer belt 110. In the configuration of the present exemplary embodiment, the range Ls is 1 mm. The range Ls can actually be measured by capturing an image of the behavior of the blade 51 in the blade nip portion Nb in the rotation axis direction of the rotating shaft 52*a* while the intermediate transfer belt 110 is moved to rotate.

As illustrated in FIG. 12B, in the present exemplary embodiment, the members are arranged such that the region, which is formed by the rotation orbit Rm of the sheet member 52*b*, overlaps the range Ls, which is the region of toner to be loosened by small displacements of the blade 51, when viewed in the rotation axis direction of the rotating shaft 52*a*. In other words, when viewed in the rotation axis direction of the rotating shaft 52*a*, at least a part of the region of the blade 51 (in the present exemplary embodiment, a region Rt) contacting the toner on the free end side of the blade in the belt conveyance direction overlaps the region formed by the rotation orbit Rm. Consequently, when the agitation member 52 passes the range Ls, as illustrated in FIG. 12C, part of the toner loosened by the small displacements of the blade 51 is conveyed by the sheet member 52*b* and supplied to the screw 53.

In the present exemplary embodiment, the blade 51 and the sheet member 52*b* are configured to contact each other. The toner is thus conveyed by the agitation member 52 including the sheet member 52*b*. The sheet member 52*b* is made of a soft member such as a PET sheet. This can minimize the impact of the contact between the blade 51 and the agitation member 52 while maximizing the use of the toner conveyance region of the sheet member 52*b*.

If the agitation member 52 is located too close to the blade 51, a length of the portion of the sheet member 52*b* contacting the blade 51 increases. Consequently, a contact time of the sheet member 52*b* increases and the sheet member 52*b* is bent greatly during the contact. Since the pressure applied to the blade 51 by the rotation of the agitation member 52 increases, the impact on the blade 51 can increase to cause a drop in the cleaning performance. In the present exemplary embodiment, a contact length of a contact region T of the blade 51 over which the sheet member 52*b* makes contact because of the rotation of the agitation member 52 is set to 1 mm. The contact length of the contact region T is referred to as a length of the blade 51 in a direction intersecting the longitudinal direction of the blade 51 parallel to the width direction of the intermediate belt 110, viewed in the rotation axis direction of the rotating shaft 52*a*. To avoid the foregoing drop in the cleaning performance, the contact length of the contact region T may desirably be set to 2 mm or less.

Figure 13A:
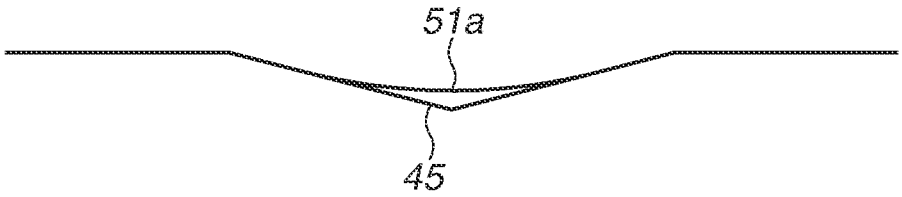
FIGS. 13A and 13B are schematic diagrams for describing states of contact between a groove and the belt according to the second exemplary embodiment.
Figure 13B:
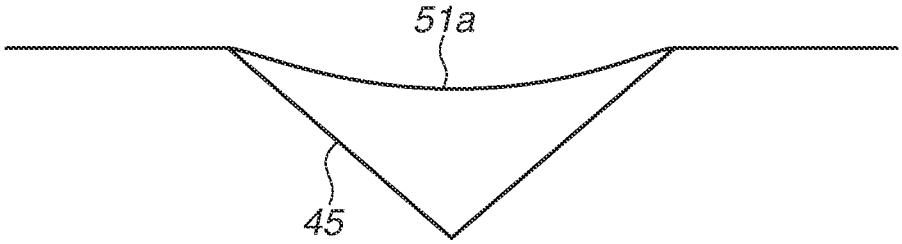

To increase the amount of toner conveyed by the foregoing agitation member 52, the displacements of the blade 51 during the rotational movement of the intermediate transfer belt 110 can be increased. A desirable shape of the grooves 45 according to the present exemplary embodiment will now be described with reference to FIGS. 13A and 13B. FIG. 13A is a schematic diagram for describing a groove shape where the displacements of the blade 51 are relatively small. FIG. 13B is a schematic diagram for describing a groove shape where the displacements of the blade 51 are relatively large.

As illustrated in FIG. 13A, if grooves 45 of gentle shape are formed, the blade 51 follows the grooves 45 as the intermediate transfer belt 110 moves to rotate. This relatively increases the contact area between the blade 51 and the intermediate transfer belt 110. As a result, the displacements of the blade 51 at positions where the grooves 45 are formed become small with respect to the shape of the blade 51 at positions where no groove 45 is formed. By contrast, if the grooves 45 have a shape illustrated in FIG. 13B, the contact area between the blade 51 and the intermediate transfer belt 110 can be made smaller than the area illustrated in FIG. 13A. This can relatively increase the displacements of the blade 51 at positions where the grooves 45 are formed.

To observe the contact state between the intermediate transfer belt 110 and the blade 51, the blade 51 was brought into contact with transparent members having the foregoing groove shapes with a linear pressure of 80 gf/cm. The contact state of the blade 51 was observed from the back sides of the transparent members. Table 1 illustrates the results. As illustrated in Table 1, to reduce the contact area between the blade 51 and the intermediate transfer belt 110 to relatively increase the displacements of the blade 51, the depth D and the width W of the grooves 45 are desirably set to satisfy D≥W/2. In the present exemplary embodiment, the depth D is set to 2.0 μm and the width W is set to 2.0 μm based on the results of Table 1.

TABLE 1

| Width W | Depth D | Contact state between blade 51 and grooves 45 |
|---|---|---|
| 2.0 μm | 0.5 μm | Full contact |
| 2.0 μm | 1.5 μm | Partial contact |
| 3.0 μm | 1.0 μm | Full contact |
| 3.0 μm | 1.5 μm | Partial contact |

If the grooves 45 formed in the intermediate transfer belt 110 according to the present exemplary embodiment have too large a depth D, the toner caught in the grooves 45 is difficult to clean. The depth D can therefore be set below an average particle diameter of the toner. The configuration of the present exemplary embodiment uses toner having an average particle size of 6 μm. The depth D is therefore desirably set to 4 μm or less. If the depth D is too small, the blade 51 is prone to follow the rotational movement of the intermediate transfer belt 110. The depth D is therefore desirably set to 0.05 μm or more.

[Operation and Effect]

Figure 14A:
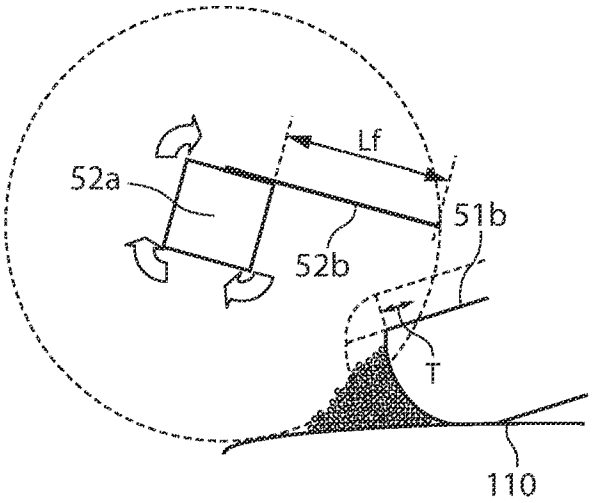
FIGS. 14A, 14B, and 14C are schematic diagrams for describing conveyance of toner according to the second exemplary embodiment, a first modification, and a first comparative example.
Figure 14B:
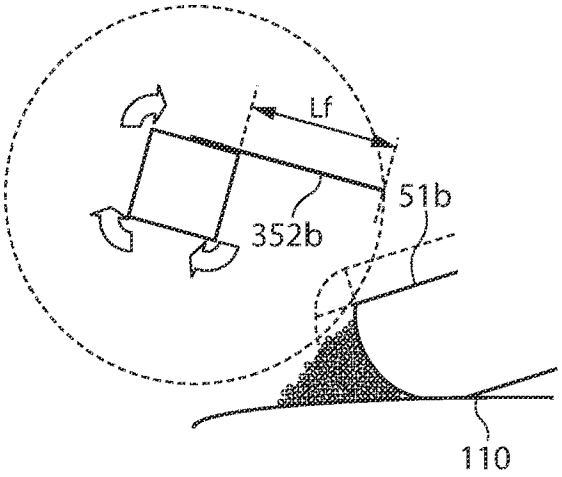
Figure 14C:
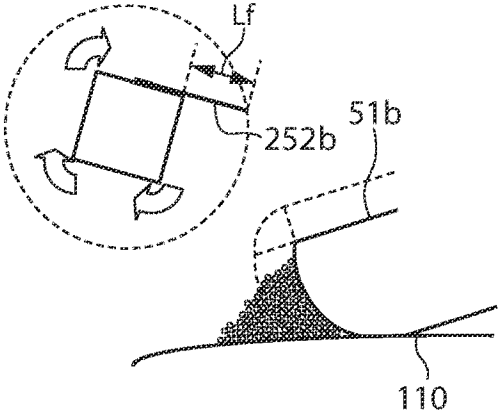

FIG. 14A is a schematic diagram for describing the configuration of the present exemplary embodiment. FIG. 14B is a schematic diagram for describing a configuration of a first modification of the present exemplary embodiment. FIG. 14C is a schematic diagram for describing a configuration of a first comparative example of the present exemplary embodiment. Compared to the configuration of the present exemplary embodiment, the first modification and the first comparative example include sheet members 352*b* and 252*b* having a small free length Lf. The sheet member 352*b* according to the first modification has a free length Lf of 4 mm. The sheet member 252*b* according to the first comparative example has a free length Lf of 2 mm A configuration including no agitation member 52 was also prepared as a second comparative example. Each configuration was examined for cleaning performance.

A method for examining the cleaning performance will be described below. A predetermined image was formed on 5000 transfer materials P in succession, and then the amount of toner remaining near the blade nip portion Nb was measured to determine the amount of residual toner. In addition, the operation for successively forming a predetermined image on 5000 transfer materials P was repeated to determine the number of transfer materials P up to which no cleaning failure occurred during the examination operation.

As the free length Lf of the sheet member decreases, the conveyance region of toner by the agitation member decreases. This increases the amount of toner that accumulates near the blade nip portion Nb and is unable to be conveyed by the agitation member. Table 2 illustrates the amount (weight) of toner remaining near the blade nip portion Nb and the number of transfer materials P up to which no cleaning failure occurred (hereinafter, referred to as a cleanable number of transfer materials) in each configuration.

TABLE 2

| | Free length Lf [mm] | Amount of residual toner [g] | Cleanable number of transfer materials [sheets] |
|---|---|---|---|
| Second exemplary embodiment | 5 | 1.9 | 30000 |
| First modification | 4 | 2.4 | 30000 |
| First comparative example | 2 | 3.5 | 12000 |
| Second comparative example | None | 4.2 | 5000 |

In the configuration of the present exemplary embodiment, the amount of residual toner was 1.9 g. No cleaning failure was observed even after the formation of a predetermined image on 30000 transfer materials P. In the configuration of the first modification with a free length Lf smaller than the length used in the present exemplary embodiment, the amount of residual toner was 2.4 g, i.e., greater than the amount of residual toner produced in the present exemplary embodiment, whereas the cleanable number of transfer materials was similar to the number of the present exemplary embodiment.

In the configuration of the first comparative example with an even smaller free length Lf than in the first modification, the amount of residual toner increased to 3.5 g. The cleanable number of transfer materials decreased to 12000. After the formation of a predetermined image on 12000 transfer materials P, toner slipped through the blade nip portion Nb was observed on an image on a transfer material P. In other words, a cleaning failure occurred. In the configuration of the second comparative example without the agitation member 52, the amount of residual toner increased to 4.2 g. The cleanable number of transfer materials decreased to 5000.

The reason is that unlike the present exemplary embodiment and the first modification where the range Ls of small displacements of the blade 51 overlaps the rotation orbit Rm of the sheet member 52*b* or 352*b*, the range Ls of small displacements of the blade 51 according to the first comparative example does not overlap the rotation orbit Rm of the sheet member 252*b*. In the first comparative example, the blade 51 made small displacements due to the presence of the grooves 45, whereas the toner loosened by the small displacements of the blade 51 was difficult for the sheet member 252*b* to convey and a drop in the cleaning performance was thus observed. In the second comparative example, the toner accumulating near the blade nip portion Nb was unable to be conveyed to the screw 53 due to the absence of the agitation member 52, and the occurrence of a cleaning failure was observed earlier than in the first comparative example.

As described above, in the configuration of the present exemplary embodiment, the grooves 45 in the intermediate transfer belt 110 enable the blade 51 to make small displacements in the belt conveyance direction as the intermediate transfer belt 110 moves to rotate. The present exemplary embodiment is configured such that the range Ls of small displacements of the blade 51 overlaps the rotation orbit Rm of the sheet member 52*b*. The toner loosened by the small displacements of the blade 51 can thus be conveyed to the screw 53 by the rotation of the agitation member 52.

The present exemplary embodiment is also configured such that, when viewed in the rotation axis direction of the rotating shaft 52*a*, at least a part of the region of the blade 51 contacting toner on the free end side of the blade 51 in the belt conveyance direction overlaps the region formed by the rotation orbit Rm. This forms the contact region T where the elastic portion 51*a* of the blade 51 contacts the sheet member 52*b*, and the toner can thus be more efficiently conveyed to the screw 53 by the agitation member 52. A drop in the cleaning performance can thereby be further reduced.

In the present exemplary embodiment, the agitation member 52 is described to include the sheet member 52*b*. However, this is not restrictive as long as the agitation member 52 can convey toner near the blade 51 without excessive impact on the blade 51. For example, a rotating brush member may be used as the agitation member 52. In such a case, similar effects to those of the present exemplary embodiment can be obtained by configuring the rotation orbit of the outermost periphery of the brush member to overlap the range Ls.

While the present exemplary embodiment has so far been described with reference to a part of the configuration of the first exemplary embodiment, the present exemplary embodiment does not need to be predicated on the configuration of the cleaning unit 50, which is a characteristic configuration of the first exemplary embodiment. In other words, a cleaning unit can be configured at least such that, when viewed in the rotation axis direction of the rotating shaft 52*a*, at least a part of the region of the blade 51 contacting toner on the free end side of the blade 51 in the belt conveyance direction overlaps the region formed by the rotation orbit Rm. This can achieve the reduction of a drop in the cleaning performance, described in the present exemplary embodiment.

Figure 15:
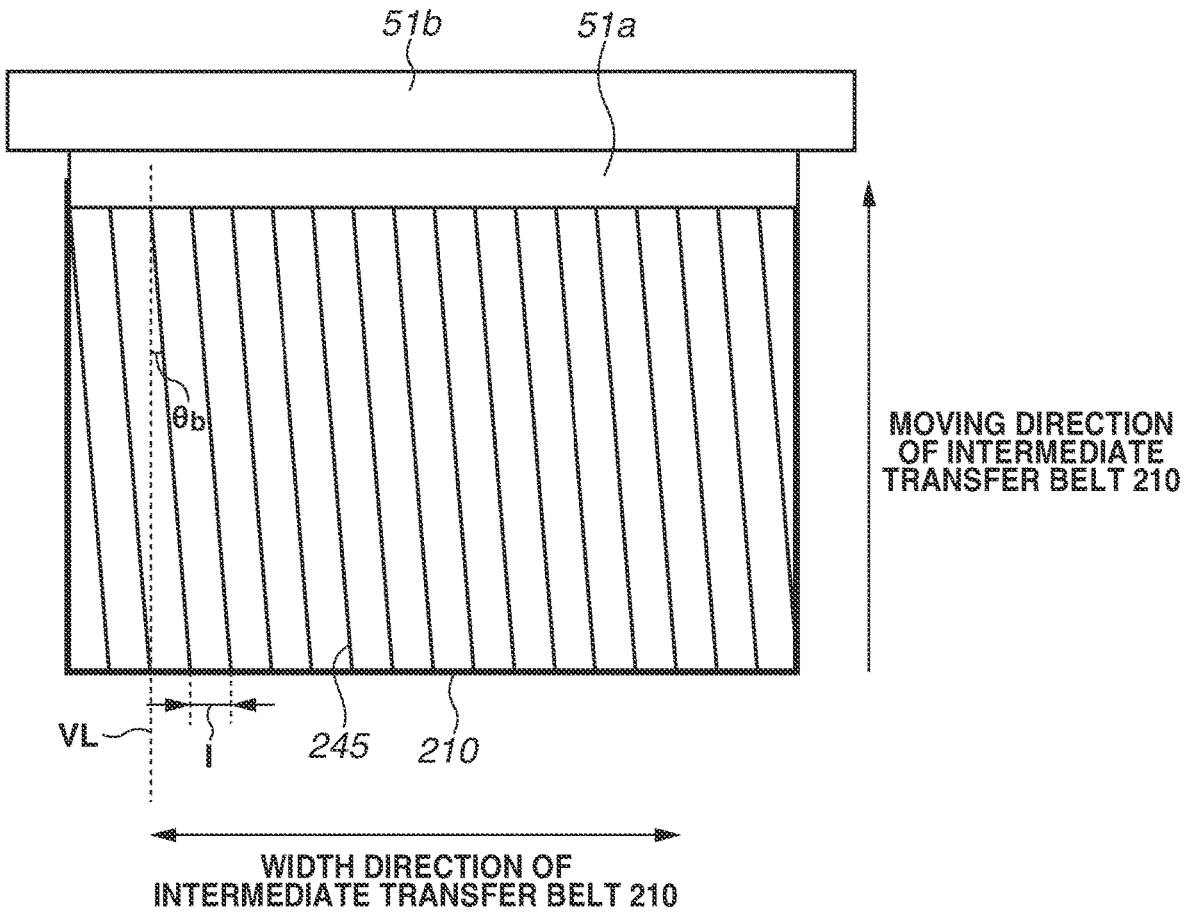
FIG. 15 is a schematic diagram for describing a configuration of a belt according to a third exemplary embodiment.

In the second exemplary embodiment, the intermediate transfer belt 110 is described to make small displacements in the width direction of the intermediate transfer belt 110 while moving to rotate. With such a configuration, the entire area of the elastic portion 51*a* in the width direction of the intermediate transfer belt 110 can contact the grooves 45. A third exemplary embodiment is different from the second exemplary embodiment in that, as illustrated in FIG. 15, grooves 245 extending along a moving direction of an intermediate transfer belt 210 are located obliquely to the moving direction of the intermediate transfer belt 210. In the present exemplary embodiment, similar components and controls to those of the second exemplary embodiment are denoted by the same reference numerals. A description thereof will be omitted.

FIG. 15 is a schematic diagram for describing a relationship between the grooves 245 formed in the surface of the intermediate transfer belt 210 and the blade 51. As illustrated in FIG. 15, the intermediate transfer belt 210 has a plurality of grooves 245 in its surface (surface layer). The plurality of grooves 245 extends along the moving direction of the intermediate transfer belt 210 at an angle $\theta_b$ to a virtual line VL drawn in the moving direction of the intermediate transfer belt 210. In the exemplary embodiment, $\theta_b$=1.5°. The grooves 245 are formed at intervals I of 18 mm in a width direction intersecting the moving direction of the intermediate transfer belt 210. In the present exemplary embodiment, the interval I between adjoining grooves 245 is set to satisfy the following formula (1):

$$I \leq L \times \tan \theta_b. \quad (1),$$

where L is a circumferential length of the intermediate transfer belt 210.

As illustrated in FIG. 15, the interval I of the grooves 245 in the width direction of the intermediate transfer belt 210 orthogonal to the moving direction of the intermediate transfer belt 210 is set to a value satisfying formula (1). The entire area of the elastic portion 51*a* of the blade 51 in the width direction of the intermediate transfer belt 210 can thus be opposed to the grooves 245 as the intermediate transfer belt 210 repeats rotation. According to the configuration of the present exemplary embodiment, the blade 51 makes small displacements described in the second exemplary embodiment over the entire area of the blade 51 as the intermediate transfer belt 210 moves to rotate, whereby the toner loosening effect can be stably obtained over the entire area of the blade 51.

As described above, according to the configuration of the present exemplary embodiment, similar effects to those of the second exemplary embodiment can be obtained even with a configuration where the intermediate transfer belt 210 does not move in the width direction of the intermediate transfer belt 210, in other words, the movement of the intermediate transfer belt 210 in the width direction is restricted.

In the present exemplary embodiment, unlike the second exemplary embodiment, the blade 51 repeats small displacements at the intervals I of formation of the grooves 245 as the intermediate transfer belt 210 moves to rotate, regardless of whether the intermediate transfer belt 210 moves in the width direction. In other words, each point of the blade 51 alternates a state of being in contact with a groove 245 and a state of not being in contact with a groove 245 at regular intervals (intervals I). The blade 51 thereby makes small displacements in fine steps, and thus the frequency of the operation for loosening the toner accumulating near the blade nip portion Nb increases. The configuration of the present exemplary embodiment therefore not just provides similar effects to those of the second exemplary embodiment, but can loosen the toner more effectively than in the second exemplary embodiment. A great amount of toner can thus be conveyed to the screw 53 by the agitation member 52.

Figure 16:
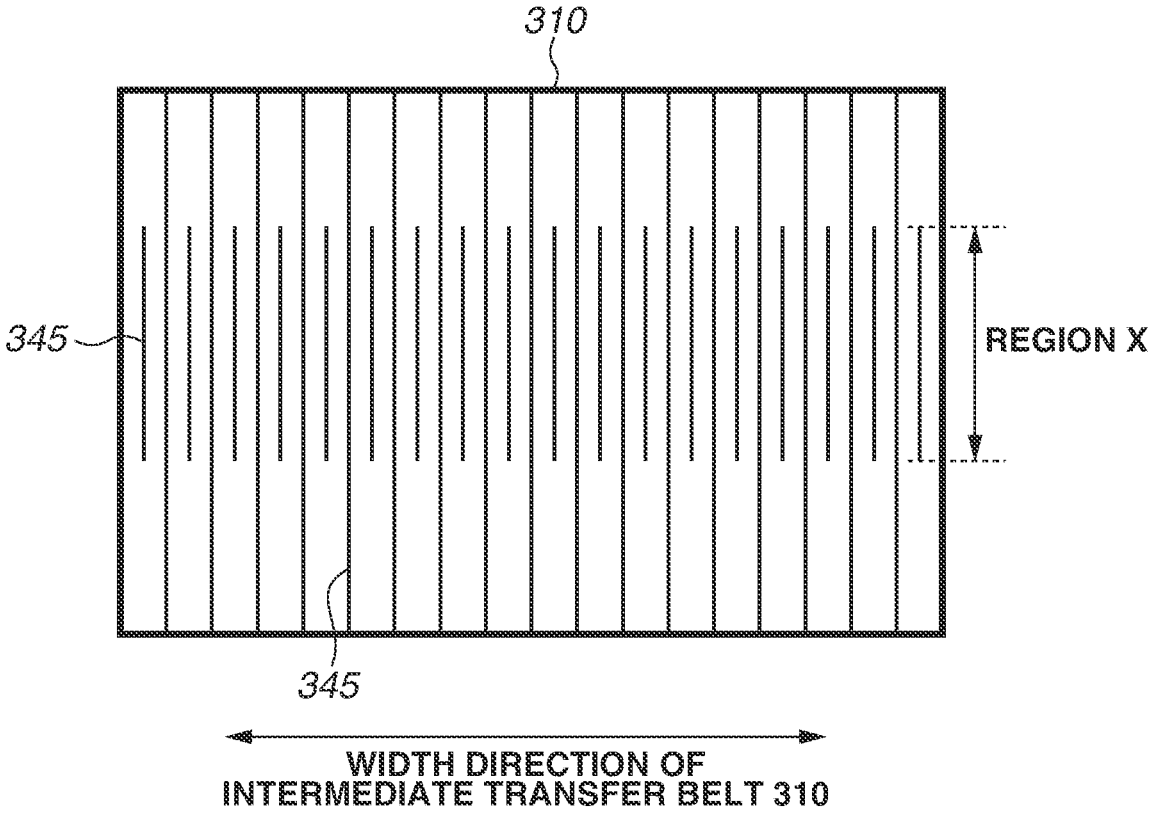
FIG. 16 is a schematic diagram for describing a configuration of a belt according to a fourth exemplary embodiment.

FIG. 16 is a schematic diagram for describing a configuration of an intermediate transfer belt 310 according to a fourth exemplary embodiment. In the present exemplary embodiment, a region where intervals of grooves 345 are different is formed as a method for changing the orientation of a blade 51. In the following description of the fourth exemplary embodiment, similar components and controls to those of the second exemplary embodiment are denoted by the same reference numerals. A description thereof will be omitted.

Specifically, in the configuration of the present exemplary embodiment, as illustrated in FIG. 16, a region X where the grooves 345 are at small intervals is formed on a part of the intermediate transfer belt 310. The region X is a region located over a certain distance in the moving direction of the intermediate transfer belt 310 (in FIG. 16, a direction orthogonal to the width direction of the intermediate transfer belt 310). In the regions other than the region X in the moving direction of the intermediate transfer belt 310, the distances between adjoining grooves 345 are set to be greater than in the region X.

In the configuration of the present exemplary embodiment, when the blade 51 passes the region X, the small intervals between the grooves 345 cause the blade 51 to make small displacements with higher frequency than when the blade 51 passes the regions other than the region X. In other words, when the blade 51 passes the region X, the operation for loosening the toner accumulating near the blade nip portion Nb is performed more frequently. The provision of the region X where the intervals of the grooves 345 are different within one rotation of the intermediate transfer belt 310 also increases the frequency of small displacements of the blade 51 at regular intervals while the intermediate transfer belt 310 rotates, whereby the state of enhanced toner loosening effect can be exerted at a regular period. As described above, the configuration of the present exemplary embodiment not just provides similar effects to those of the second exemplary embodiment, but can loosen the toner more effectively than in the second exemplary embodiment. A great amount of toner can thus be conveyed to the screw 53 by the agitation member 52.

The region X where the grooves 345 are at small intervals may be formed by forming grooves 345 at equal distances in the intermediate transfer belt 310 as in the second exemplary embodiment and then using the same die again to form grooves 345 between the grooves 345 formed at equal distances. Such a method is not restrictive, and the region X may be formed by using a die including a pattern of narrow-spaced grooves 345 in part.

Specifically, in the present exemplary embodiment, the distances between the adjoining grooves 345 in the region X are 10 μm. The distances between the adjoining grooves 345 in the regions other than the region X are 20 μm. As a method for forming the grooves 345, a die having protrusions at intervals of 20 μm is initially pressed against the intermediate transfer belt 310 to form a region where the groove interval is 20 μm. Then, the same die is used to form the region X where the groove interval is 10 μm by pressing the die to form grooves with a shift of 10 μm from the positions where the grooves 345 are formed in the width direction of the intermediate transfer belt 310.

In the present exemplary embodiment, 20 μm and 10 μm are described as examples of the intervals of the grooves 345. However, this is not restrictive. The intermediate transfer belt 310 may include grooves formed at greater intervals or smaller intervals than those used in the present exemplary embodiment. The intermediate transfer belt 310 may also include a grooveless region to change the orientation of the blade 51 in this region.

The region X may be formed by pressing the same groove die against the intermediate transfer belt 310 to form grooves such that a starting point and an end point of the die impression overlap. For example, in the case of forming oblique grooves as described in the third exemplary embodiment, a groove region can be formed with a die for one rotation of the intermediate transfer belt plus a certain distance (e.g., 100 mm) with the tilt angle adjusted such that the groove shapes do not overlap already formed shapes completely after one rotation. This can form a region over the certain distance where the groove shapes do not overlap and the groove interval is different and smaller. Such groove shapes can provide both the oblique groove configuration of the third exemplary embodiment and the region of different groove interval. This method is extremely effective since uniform orientation changes of the blade 51 in the longitudinal direction perpendicular to the rotation direction of the intermediate transfer belt and enhancement of the orientation changing effect can both be achieved.

In the first to fourth exemplary embodiments, the image forming apparatus 100 of intermediate transfer type using an intermediate transfer belt has been described. However, this is not restrictive. Similar effects to those described in the first to fourth exemplary embodiments can be obtained by employing the components and controls described in the first to fourth exemplary embodiments for an image forming apparatus of direct transfer type using a conveyance belt for conveying a transfer material P.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-199100, filed Oct. 31, 2019, No. 2019-216691, filed Nov. 29, 2019, and No. 2020-148807, filed Sep. 4, 2020, which are hereby incorporated by reference herein in their entirety.

What is claimed is:

1. A cleaning device configured to collect toner remaining on a movable image bearing member configured to bear a toner image, the cleaning device comprising:

a collection member configured to contact the image bearing member and collect the toner remaining on the image bearing member;

a conveyance member configured to convey the toner collected by the collection member, the conveyance member being located above a position where the collection member contacts the image bearing member in a direction of gravity;

a rotatable flexible agitation member configured to agitate the toner collected by the collection member, the agitation member being located above the position where the collection member contacts the image bearing member in a direction of gravity; and an accommodation unit configured to accommodate the toner collected from the image bearing member by the collection member, the accommodation unit accommodating the conveyance member and the agitation member, wherein the conveyance member extends in a width direction of the image bearing member orthogonal to a moving direction of the image bearing member, and conveys the toner in the width direction by rotation, and wherein the accommodation unit includes a wall portion located inside a rotation orbit of an outermost peripheral portion of the agitation member, downstream of the collection member and upstream of the conveyance member in a rotation direction of the agitation member when viewed in a rotation axis direction of the conveyance member, so that the agitation member, when rotating in contact with the wall portion, conveys the toner with the agitation member deformed.

2. The cleaning device according to claim 1, wherein when viewed in the rotation axis direction of the conveyance member, an axial center of rotation of the agitation member is located below an axial center of rotation of the conveyance member in a direction of gravity.

3. The cleaning device according to claim 1, wherein the accommodation unit includes a holding portion extending in the width direction and configured to hold the conveyance member, and a region where the holding portion is not located, the region being located downstream of the wall portion and upstream of the collection member in the rotation direction of the agitation member.

4. The cleaning device according to claim 3, wherein the agitation member is configured to rotate to establish a first state where an end contacting the wall portion is deformed upstream in the rotation direction of the agitation member and a second state where the end is separated from the wall portion and deformation of the end is released, and wherein toner scooped up by the agitation member is supplied to the conveyance member via the region by reaction in shifting from the first state to the second state.

5. The cleaning device according to claim 1, wherein the rotation axis direction of the conveyance member is parallel to a rotation axis direction of the agitation member.

6. The cleaning device according to claim 1, wherein the collection member is a cleaning blade contacting the image bearing member in a counter direction with respect to the moving direction of the image bearing member.

7. The cleaning device according to claim 1, wherein a rotation direction of the conveyance member is opposite to the rotation direction of the agitation member.

8. An image forming apparatus comprising:

an image bearing member configured to bear a toner image; and a collection unit configured to collect toner remaining on the image bearing member, wherein the collection unit includes a collection member configured to contact the image bearing member and collect the toner remaining on the image bearing member, a conveyance member configured to convey the toner collected by the collection member, the conveyance member being located above a position where the collection member contacts the image bearing member in a direction of gravity, a rotatable flexible agitation member configured to agitate the toner collected by the collection member, the agitation member being located above the position where the collection member contacts the image bearing member in a direction of gravity, and an accommodation unit configured to accommodate the toner collected from the image bearing member by the collection member, the accommodation unit accommodating the conveyance member and the agitation member, wherein the conveyance member extends in a width direction of the image bearing member orthogonal to a moving direction of the image bearing member and conveys the toner in the width direction by rotation, and wherein the accommodation unit includes a wall portion located inside a rotation orbit of an outermost peripheral portion of the agitation member, downstream of the collection member and upstream of the conveyance member in a rotation direction of the agitation member when viewed in a rotation axis direction of the conveyance member, so that the agitation member, when rotating in contact with the wall portion, conveys the toner with the agitation member deformed.

9. The image forming apparatus according to claim 8, wherein when viewed in the rotation axis direction of the conveyance member, an axial center of rotation of the agitation member is located below an axial center of rotation of the conveyance member in a direction of gravity.

10. The image forming apparatus according to claim 8, wherein the accommodation unit includes a holding portion extending in the width direction and configured to hold the conveyance member, and a region where the holding portion is not located, the region being located downstream of the wall portion and upstream of the collection member in the rotation direction of the agitation member.

11. The image forming apparatus according to claim 10, wherein the agitation member is configured to rotate to establish a first state where an end contacting the wall portion is deformed upstream in the rotation direction of the agitation member and a second state where the end is separated from the wall portion and deformation of the end is released.

12. The image forming apparatus according to claim 8, wherein the rotation axis direction of the conveyance member is parallel to a rotation axis direction of the agitation member.

13. The image forming apparatus according to claim 8, further comprising:

a developing unit configured to supply toner to the image bearing member; and a transfer member configured to contact the image bearing member to form a transfer portion, and transfer the toner image borne on the image bearing member to a transfer material or an intermediate transfer member in the transfer portion, wherein the image bearing member is a rotatable photosensitive member, an electrostatic latent image on the photosensitive member being developed by the developing unit, and wherein the collection member is located downstream of the transfer portion and upstream of the developing unit in a rotation direction of the photosensitive member.

14. The image forming apparatus according to claim 8, further comprising:

a photosensitive member; and a transfer member configured to contact the image bearing member to form a transfer portion, and transfer the toner image borne on the image bearing member to a transfer material in the transfer portion, wherein the image bearing member is an endless intermediate transfer member configured to bear the toner image transferred from the photosensitive member, and wherein the collection member is located downstream of the transfer portion and upstream of a position where the photosensitive member contacts the intermediate transfer member in a moving direction of the intermediate transfer member.

15. The image forming apparatus according to claim 14, further comprising a first stretching member and a second stretching member configured to stretch the intermediate transfer member, wherein the transfer member is located at a position opposed to the first stretching member via the intermediate transfer member, and the collection member is located at a position opposed to the first stretching member via the intermediate transfer member.

16. The image forming apparatus according to claim 15, wherein the first stretching member is a driving roller configured to rotate by receiving driving force, the driving roller including a first gear at an axis end in a rotation axis direction, and wherein the agitation member and the conveyance member are configured to be rotated by the driving force transmitted via the first gear.

17. The image forming apparatus according to claim 15, wherein the toner collected into the accommodation unit by the collection member is conveyed to a collection container located at a position different from a position of the collection unit by the conveyance member, the collection container being located within a region formed by an inner peripheral surface of the intermediate transfer member stretched by the first and second stretching members.

18. An image forming apparatus comprising:

an image bearing member configured to bear a toner image;

a movable endless belt configured to contact the image bearing member;

a transfer member configured to contact an inner peripheral surface of the belt and transfer the toner image from the image bearing member to the belt; and a collection unit configured to collect toner remaining on the belt, wherein the collection unit includes a collection member configured to contact the belt and collect the toner remaining on the belt, the collection member being fixed at one end, the other end of the collection member being a free end contacting the belt, and a rotatable agitation member configured to agitate the toner collected by the collection member, wherein the belt includes a plurality of grooves formed in an outer peripheral surface contacting the collection member, the plurality of grooves being formed along a moving direction of the belt and arranged in a width direction of the belt intersecting the moving direction, wherein a region of the collection member contacting the toner, the region being at least a part of the other end of the collection member in the moving direction, overlaps a region formed by a rotation orbit of an outermost peripheral portion of the agitation member when viewed in a rotation axis direction of the agitation member, so that the agitation member, when rotating in contact with the wall portion, conveys the toner with the agitation member deformed, and wherein the belt includes a first region and a second region arranged in the moving direction, the grooves being formed in the first region, an interval of grooves formed in the second region being different from an interval of the grooves formed in the first region.

19. The image forming apparatus according to claim 18, wherein the collection member is a cleaning blade contacting the belt in a counter direction with respect to a moving direction of the image bearing member.

20. The image forming apparatus according to claim 18, wherein the agitation member includes a rotatable rotating shaft and a flexible sheet member, the sheet member being fixed to the rotating shaft at one end, the other end of the flexible sheet member being a free end, and wherein the rotation orbit is a rotation orbit of a leading edge of the free end of the sheet member.

21. The image forming apparatus according to claim 18, wherein the collection unit includes a conveyance member configured to convey the toner in the width direction of the belt, and wherein the toner collected from the belt by the collection member is conveyed toward the conveyance member by rotation of the agitation member.

22. The image forming apparatus according to claim 18, wherein the plurality of grooves is obliquely formed along the moving direction at an angle of $\theta_b$ to the moving direction, and an interval I between adjoining ones of the grooves in the width direction satisfies the following formula:

$$I \leq L \times \tan \theta_b,$$

where L is a circumferential length that is a length of the grooves in the moving direction.

* * * * *